US007109944B2

(12) United States Patent
Sato et al.

(10) Patent No.: US 7,109,944 B2
(45) Date of Patent: Sep. 19, 2006

(54) ANTENNA USING VARIABLE CAPACITANCE ELEMENT AND WIRELESS COMMUNICATION APPARATUS USING THE SAME

(75) Inventors: Akinori Sato, Kyoto (JP); Takanori Ikuta, Kyoto (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 11/040,526

(22) Filed: Jan. 21, 2005

(65) Prior Publication Data

US 2005/0162324 A1 Jul. 28, 2005

(30) Foreign Application Priority Data

Jan. 26, 2004 (JP) ..... P2004-016700
Jan. 26, 2004 (JP) ..... P2004-016701

(51) Int. Cl.
*H01Q 1/50* (2006.01)
*H01Q 9/00* (2006.01)

(52) U.S. Cl. ..... 343/860; 343/745; 343/861

(58) Field of Classification Search ..... 343/700 MS, 343/745, 850, 860, 861
See application file for complete search history.

(56) References Cited

U.S. PATENT DOCUMENTS 5,874,926 A 2/1999 Tsuru et al. ..... 343/860
6,100,773 A 8/2000 Nakamichi et al. ..... 333/32
6,608,603 B1 * 8/2003 Alexopoulos et al. ..... 343/860
6,933,893 B1 * 8/2005 Rubinshteyn et al. ..... 343/700 MS
2005/0085204 A1 * 4/2005 Poilasne et al. ..... 455/193.1

FOREIGN PATENT DOCUMENTS

JP 09-307331 11/1997
JP 11-111566 4/1999
JP 3307248(10-173426) 7/2002
JP 2002-232232 8/2002

* cited by examiner

*Primary Examiner*—Shih-Chao Chen
(74) *Attorney, Agent, or Firm*—Hogan & Hartson LLP

(57) ABSTRACT

An antenna is constituted in which a variable capacitance capacitor portion Ct is connected between an antenna element and a ground. In the variable capacitance capacitor, a plurality of variable capacitance elements using a thin film dielectric layer whose dielectric constant is changed by a voltage applied are connected in parallel with regard to direct current component and in series with regard to high frequency component between an antenna-element-side terminal and a ground-side terminal. The capacitance change ratio of the variable capacitance capacitor that depends on the bias signal can be utilized to the maximum so as to perform impedance matching so that the electrical length of the antenna element is changed, and thus, the operating frequency can be changed. In addition, the antenna having small waveform distortion and intermodulation distortion, high power handling capability and low loss at high frequencies can be realized.

8 Claims, 14 Drawing Sheets

ANTENNA USING VARIABLE CAPACITANCE ELEMENT AND WIRELESS COMMUNICATION APPARATUS USING THE SAME

BACKGROUND OF THE INVENTION

1. Field of the Invention

The present invention relates to an antenna used in, for example, communication equipment such as mobile telephones and a high frequency component mounted on such communication equipment, more specifically, an antenna using variable capacitance element having excellent characteristics in terms of power handling capability, low distortion and low loss in which the electrical length of the antenna can be varied by changing the capacitance using a variable capacitance capacitor, and a wireless communication apparatus using the antenna.

The invention relates to an antenna used for wireless communication in a microwave band, a millimeter-wave band or the like in which a variable matching circuit having a variable capacitance capacitor is connected between a feeding terminal of an antenna element and a feeding power source, and an operating frequency of the antenna can be varied by changing the capacitance of the variable capacitance capacitor, and a wireless communication apparatus using the same. In particular, the invention relates to an antenna having excellent characteristics in terms of power handling capability, low distortion and low loss, and a wireless communication apparatus using the same.

2. Description of the Related Art

An antenna is one of the principal components for communication equipment, and of these components, the antenna is a large component and is desired to be smaller with the promotion of the miniaturization of the equipment. The size of the antenna has a close relationship with a bandwidth and has a size necessary to ensure the bandwidth that is required by the system of the communication equipment.

On the other hand, when the operating frequency of the antenna is variable, the antenna only has to have a size necessary to ensure the bandwidth at that point of time, and therefore it is not necessary that the size of the antenna is large so as to be ready for the bands that are not used. Therefore, the size of the antenna can be reduced significantly.

Then, in order to make the operating frequency of the antenna variable, it has been proposed to connect a variable capacitance diode as a variable capacitor to the antenna or connect a resonance frequency adjusting circuit including a variable capacitance diode as a variable capacitance element to the antenna so as to change the operating frequency, or switch the capacitance that is to be connected to an antenna element with a switch so as to change the operating frequency (e.g., see Japanese Examined Patent Publication JP-B2 3307248 and Japanese Unexamined Patent Publication JP-A 2002-232232).

However, the variable capacitance diode has the problem derived from its material characteristics that the power handling capability is low, and the distortion characteristics due to the nonlinearity of the capacitance are large, so that the variable capacitance diode only can be used in receivers and receiving circuits having a small operating power. In other words, the variable capacitance diode cannot be used in transmitters and transmitting circuits having a large operating power. Furthermore, there is the problem that the loss at a high frequency is large.

In the antenna using a resonance frequency adjusting circuit including a variable capacitance diode that has been proposed in JP-B2 3307248, the variable capacitance diode has a capacitance variation at a high frequency voltage. Therefore, when the antenna has a high frequency voltage, the distortion characteristics such as waveform distortion or intermodulation distortion become large. In order to improve the distortion characteristics, it is necessary to decrease the high frequency electric field strength of the variable capacitance diode so as to reduce the capacitance variation due to the high frequency voltage. For this purpose, it is effective to increase the thickness of a capacitance layer made of a p-n junction layer in the variable capacitance diode. However, when the thickness of the capacitance layer is increased, the direct electric field strength is reduced, and the capacitance change ratio is decreased, and thus the control width of the frequency of the frequency variable antenna is decreased.

Furthermore, since with high frequency signals, current easily flows through the variable capacitance diode, during a period in which the variable capacitance diode is used in a resonance frequency adjusting circuit, which is also a high frequency circuit, heat is generated due to the loss resistance in the variable capacitance diode, and the variable capacitance diode is damaged. Thus, the power handling capability of the frequency variable antenna with respect to high frequency signals is low. To deal with this problem of power handling capability, it is effective to increase the thickness of the capacitance layer so as to reduce the amount of heat generated per unit volume. However, when the thickness of the capacitance layer is increased, the direct electric field strength is decreased, and the capacitance change ratio is decreased, and thus the control width of the frequency of the antenna is decreased.

In addition, when the variable capacitance diode is used, a bias signal supplied thereto is supplied to the variable capacitance diode from a bias terminal via a bias supply circuit. Therefore, an independent bias supply circuit constituted by a choke coil or the like that is separated from the variable capacitance diode is necessary. Therefore, it is necessary to design a bias supply circuit, and time and efforts are required for adjustment thereof. Moreover, since a circuit employing the variable capacitance diode and the bias supply circuit are constituted as separate components, the size as a whole is increased.

Furthermore, since the variable capacitance diode has a polarity with respect to an applied voltage, it is necessary to pay attention to the polarity not only at the time of design, but also at the time of mounting, and it takes time and efforts for this.

In the configuration in which the operating frequency is changed by switching a capacitor connected to an antenna element with a switch as disclosed in JP-A 2002-232232, the operating frequency that can be realized cannot be continuously variable and is limited to two different frequencies.

Furthermore, there is a demand for achieving higher performance and reducing the size of wireless communication apparatuses. Such a demand is strong especially for mobile telephones. In particular, there is an increasingly strong demand for further reduction of the size for the antenna, which is a component thereof, because the antenna is a leading component of the wireless communication apparatus but has a large size. There is a close relationship between the size of an antenna element constituting an antenna and the bandwidth, and in order to ensure the operating frequency and the bandwidth necessary for transmission of signals that is required by the communication system, the corresponding size is necessary.

On the other hand, it is possible to adjust the communication frequency to the necessary frequency as appropriate by making the operating frequency of the antenna variable. Therefore, even an antenna having a narrow bandwidth can be used. As a result, a compact antenna element in which the bandwidth is reduced can be used. Then, in order to make the operating frequency of the antenna variable, it has conventionally been proposed to connect a variable matching circuit having a variable capacitance element between an antenna element and a load, and to use a variable capacitance diode such as varactor diode as a variable capacitance element (e.g., see Japanese Unexamined Patent Publication JP-A 9-307331 (1997)). Furthermore, instead of the variable capacitance diode, a variable matching circuit combined with a variable capacitance capacitor also has been proposed (e.g., see Japanese Unexamined Patent Publication JP-A 11-111566 (1999)).

However, the antenna connected to the variable matching circuit having a variable capacitance diode as proposed in JP-A 9-307331 has the problem that the power handling capability is low, and the distortion characteristics due to the nonlinearity of the capacitance are large, so that the variable capacitance diode only can be used in receivers and receiving circuits having a small operating power. In other words, the variable capacitance diode cannot be used in transmitters or transmitting circuits having a large operating power. Furthermore, there is the problem that the loss at a high frequency is large.

In the variable matching circuit employing a variable capacitance capacitor as proposed in JP-A 11-111566, the variable capacitance capacitor has a capacitance variation also due to a high frequency voltage, and therefore when the variable matching circuit has a high frequency voltage, the distortion characteristics such as waveform distortion and intermodulation distortion become large. In order to improve the distortion characteristics, it is necessary to decrease the high frequency electric field strength of the variable capacitance capacitor so as to reduce the capacitance variation due to the high frequency voltage. For this purpose, it is effective to increase the thickness of a dielectric layer. However, when the thickness of the dielectric layer is increased, the direct electric field strength is reduced, and the capacitance change ratio is decreased, and as a result, in the variable matching circuit of the antenna, the control width of the operating frequency of the antenna is decreased.

Furthermore, since with high frequency signals, current easily flows through the variable capacitance capacitor, during a period in which the variable capacitance capacitor is used in a variable matching circuit, which is also a high frequency circuit, heat is generated due to the loss resistance in the variable capacitance capacitor, and the variable capacitance capacitor is damaged. Thus, the power handling capability of the variable matching circuit of the antenna with respect to high frequency signals is low. To deal with this problem of power handling capability, it is effective to increase the thickness of the dielectric layer so as to reduce the amount of heat generated per unit volume. However, when the thickness of the dielectric layer is increased, the direct electric field strength is decreased, and the capacitance change ratio is decreased, and as a result, in the variable matching circuit of the antenna, the control width of the operating frequency of antenna is decreased.

In addition, as shown in an equivalent circuit diagram of an example of a variable matching circuit in a conventional antenna in FIG. 14, a bias signal is supplied to a variable capacitance diode 201 from a bias terminal V via a bias supply circuit G. Thus, the independent bias supply circuit G that is constituted by a choke coil L2 is necessary in the variable matching circuit. Therefore, it is necessary to design the bias supply circuit G separately from the variable matching circuit, and time and efforts are required for adjustment thereof. Moreover, since the variable matching circuit and the bias supply circuit G are constituted as separate components, the size of the circuit as a whole is increased. The same applies to the case where the variable capacitance diode is replaced by a variable capacitance capacitor.

Furthermore, in the same manner as above, since the variable capacitance diode 201 has a polarity with respect to an applied voltage, it is necessary to pay attention to the polarity not only at the time of design, but also at the time of mounting, and it takes time and efforts for this.

SUMMARY OF THE INVENTION

The invention is devised in view of the problems of the conventional technique as above and its object is to provide an antenna using variable capacitance element having excellent characteristics in terms of power handling capability, low distortion and low loss.

Another object of the invention is to provide an antenna in which an operating frequency of an antenna can be varied, and a variable matching circuit including a variable capacitance capacitor having excellent characteristics in terms of power handling capability, low distortion and low loss is connected between a feeding terminal of an antenna element and a feeding power source.

Furthermore, still another object of the invention is to provide an antenna that does not require a independent bias supply circuit for a variable capacitance element, that can be handled in a simple manner and that can vary the operating frequency thereof.

Yet another object of the invention is to provide a wireless communication apparatus using the antenna as above.

The invention provides an antenna comprising:

an antenna element; and a variable capacitance capacitor connected between the antenna element and a ground, including an antenna-element-side terminal and a ground-side terminal, wherein in the variable capacitance capacitor, a plurality of variable capacitance elements using a thin film dielectric layer whose dielectric constant is changed by a voltage applied are connected between the antenna-element-side terminal and the ground-side terminal, in parallel to each other with regard to direct current component and in series with each other with respect to high frequency component.

The invention provides an antenna comprising:

an antenna element having a feeding terminal; and a variable matching circuit which is connected between the feeding terminal of the antenna element and a feeding power source and has a variable capacitance capacitor including an input terminal and an output terminal, wherein in the variable capacitance capacitor, a plurality of variable capacitance elements using a thin film dielectric layer whose dielectric constant is changed by a voltage applied are connected between the input terminal and the output terminal, in parallel to each other with regard to direct current component and in series with each other with regard to high frequency component.

In the invention, the variable capacitance capacitor has a bias supply circuit that is connected to electrodes of the plurality of variable capacitance elements and includes at least one of a resistance component and an inductor component.

In the invention, the thin film dielectric layer is a dielectric layer having high dielectric constant made of a perovskite oxide crystal containing at least Ba, Sr, and Ti.

The invention provides a wireless communication apparatus comprising:

the antenna mentioned above; and at least one of a transmitting circuit and a receiving circuit, the one being connected to the antenna.

According to the invention, in the antenna, a variable capacitance capacitor is connected between an antenna element and a ground, and in the variable capacitance capacitor, a plurality of variable capacitance elements using a thin film dielectric layer whose dielectric constant is changed by a voltage applied are connected between an antenna-element-side terminal and a ground-side terminal, in parallel to each other with regard to direct current component and in series with each other with regard to high frequency component. Since the plurality of variable capacitance elements are connected in parallel to each other with regard to direct current component, a predetermined bias signal can be applied to each variable capacitance element. Therefore, the capacitance change ratio of each of the variable capacitance elements that depends on the bias signal can be utilized to the maximum, so that the electrical length of the antenna is changed, and thus the resonance frequency is changed. Thus, the operating frequency of the antenna can be changed to a desired frequency in a stable manner.

According to the invention, in the variable capacitance capacitor connected between the antenna element and the ground, the plurality of variable capacitance elements are connected in series with each other with regard to high frequency component. Therefore, a high frequency voltage applied to the variable capacitance elements is divided into each of the variable capacitance elements, and therefore the high frequency voltage applied individually to the variable capacitance elements is divided and thus reduced. Therefore, the capacitance variation of the variable capacitance capacitor with respect to high frequency signals can be suppressed to be small. Consequently, in the antenna, waveform distortion, intermodulation distortion and the like of signals radiated by the antenna can be suppressed. In addition, since the plurality of variable capacitance elements are connected in series with each other with regard to high frequency component, the same effect as the thickness of the dielectric layer of the variable capacitance element is increased can be obtained, and the amount of heat generated per unit volume due to loss resistance of the variable capacitance capacitor can be reduced. Therefore, the power handling capability of the antenna in which this variable capacitance capacitor is connected between the antenna element and the ground can be improved.

According to the invention, the variable capacitance elements using a thin film dielectric layer whose dielectric constant is changed by a voltage applied to the variable capacitance capacitor that is connected between the antenna element and the ground are used. Thus, the loss in the variable capacitance capacitor can be reduced at high frequency. Therefore, the loss of the frequency variable antenna in which this variable capacitance capacitor is connected between the antenna element and the ground can be reduced.

According to the invention, a variable matching circuit having a variable capacitance capacitor is connected between a feeding terminal of an antenna element and a feeding power source, and in the variable capacitance capacitor, a plurality of variable capacitance elements using a thin film dielectric layer whose dielectric constant is changed by a voltage applied are connected between an input terminal and an output terminal, in parallel to each other with regard to direct current component and in series with each other with regard to high frequency component. Since a plurality of variable capacitance elements are connected in parallel to each other with regard to direct current component, a predetermined bias signal can be applied to each variable capacitance element. Therefore, the capacitance change ratio of each of the variable capacitance elements that depends on the bias signal can be utilized to the maximum, so that the input impedance of the antenna element is matched with the characteristic impedance of the transmitting circuit or the receiving circuit of a wireless communication apparatus, and the capacitance of the variable capacitance elements is changed, and thus the resonance frequency of the antenna element is adjusted as appropriate. Thus, the operating frequency of the antenna can be changed to a desired frequency in a stable manner.

According to the invention, in the variable capacitance capacitor of the variable matching circuit connected between a feeding terminal of an antenna element and a feeding power source, the antenna element and the feeding power source, a plurality of variable capacitance elements are connected in series with each other with regard to high frequency component. Therefore, a high frequency voltage applied to the variable capacitance elements is divided into each of the variable capacitance elements, and therefore the high frequency voltage applied individually to the variable capacitance elements is divided and thus reduced. Therefore, the capacitance variation of the variable capacitance capacitor with respect to high frequency signals can be suppressed to be small. Consequently, in the antenna, waveform distortion, intermodulation distortion and the like can be suppressed. In addition, since the plurality of variable capacitance elements are connected in series with each other with regard to high frequency component, the same effect as the thickness of the dielectric layer of the variable capacitance element is increased can be obtained, and the amount of heat generated per unit volume due to loss resistance of the variable capacitance capacitor can be reduced. Therefore, the power handling capability of the antenna can be improved.

According to invention, the variable capacitance elements using a thin film dielectric layer whose dielectric constant is changed by a voltage applied to the variable capacitance capacitor that is connected between the feeding terminal of the antenna element and the feeding power source are used. Thus, the loss in the variable capacitance capacitor can be reduced at high frequency. Therefore, the loss of the antenna can be reduced.

Furthermore, according to the invention, when the variable capacitance capacitor has a bias supply circuit that is connected to electrodes of the plurality of variable capacitance elements and includes at least one of a resistance component and an inductor component. Then, an independent bias supply circuit that is mounted on an external wiring board as in a conventional antenna using a variable capacitance diode or a conventional variable matching circuit is not necessary, and therefore the antenna can be compact and can be handled with ease.

According to the invention, high temperature sputtering is performed at a high substrate temperature, for example, at 800° C., until a film having a desired thickness can be obtained, using a dielectric material that can provide a perovskite oxide crystal as a target. Thereby, the thin film dielectric layer having a high dielectric constant, a large capacitance change ratio and low loss can be obtained without performing a heat treatment after sputtering.

According to the invention, the operating frequency can be changed easily and stably to a desired frequency, and therefore antenna having small waveform distortion and intermodulation distortion, high power handling capability and low loss can be provided. Furthermore, an independent bias supply circuit is not necessary, and therefore a compact antenna that can be handled with ease and in which the operating frequency thereof can be varied can be provided.

According to the invention, the wireless communication apparatus comprises the antenna mentioned above, and at least one of the transmitting circuit and the receiving circuit, the one being connected to the antenna. Therefore, good wireless communication can be performed at variable frequencies with good antenna characteristics with respect to a desired frequency in a variable range of the frequency while achieving a low height and a small size of the device. That is, communication can be provided with good antenna characteristics adjusted all the time with respect to a desired frequency in a variable range of the frequency while achieving a low height and a small size of the device, and good wireless communication can be performed all the time.

According to the invention, the wireless communication apparatus includes the antenna of the invention, and at least one of the transmitting circuit and the receiving circuit corresponding to a wireless signal of various different frequency bands, the one being connected to the antenna. Therefore, a compact, high performance and frequency variable wireless communication apparatus that is operable at various different frequencies with one antenna that can be of low height and small size, has good antenna characteristics with respect to a desired frequency in a variable range of the frequency while achieving a low height and a small size of the device, and can perform good wireless communication at variable frequencies can be provided.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Hereinafter, An antenna according to the invention will be described in detail with reference of the accompanying drawings.

Figure 1:
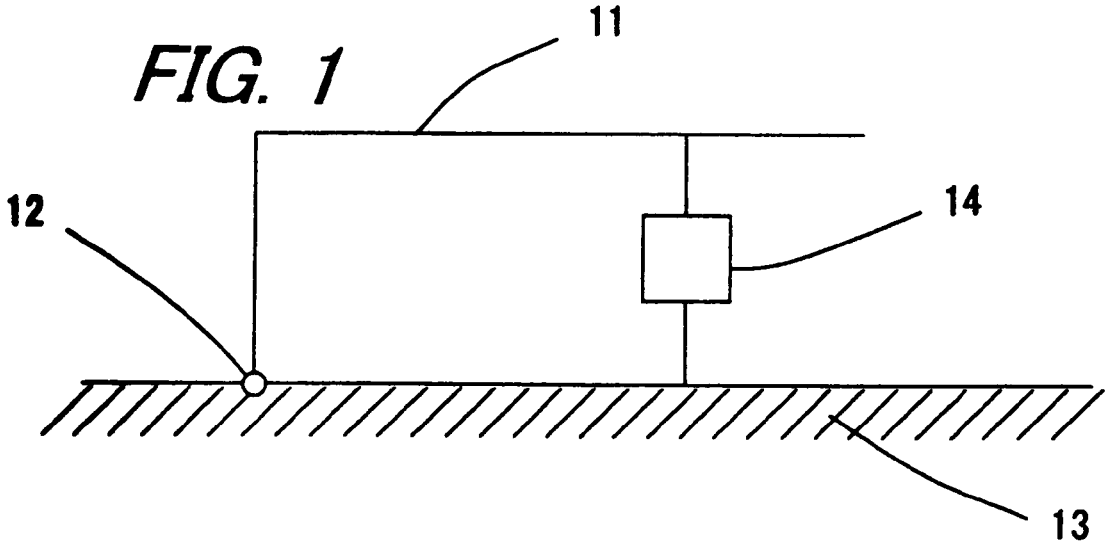
FIG. 1 is a conceptual view showing an antenna according to a first embodiment of the invention.
Figure 2:
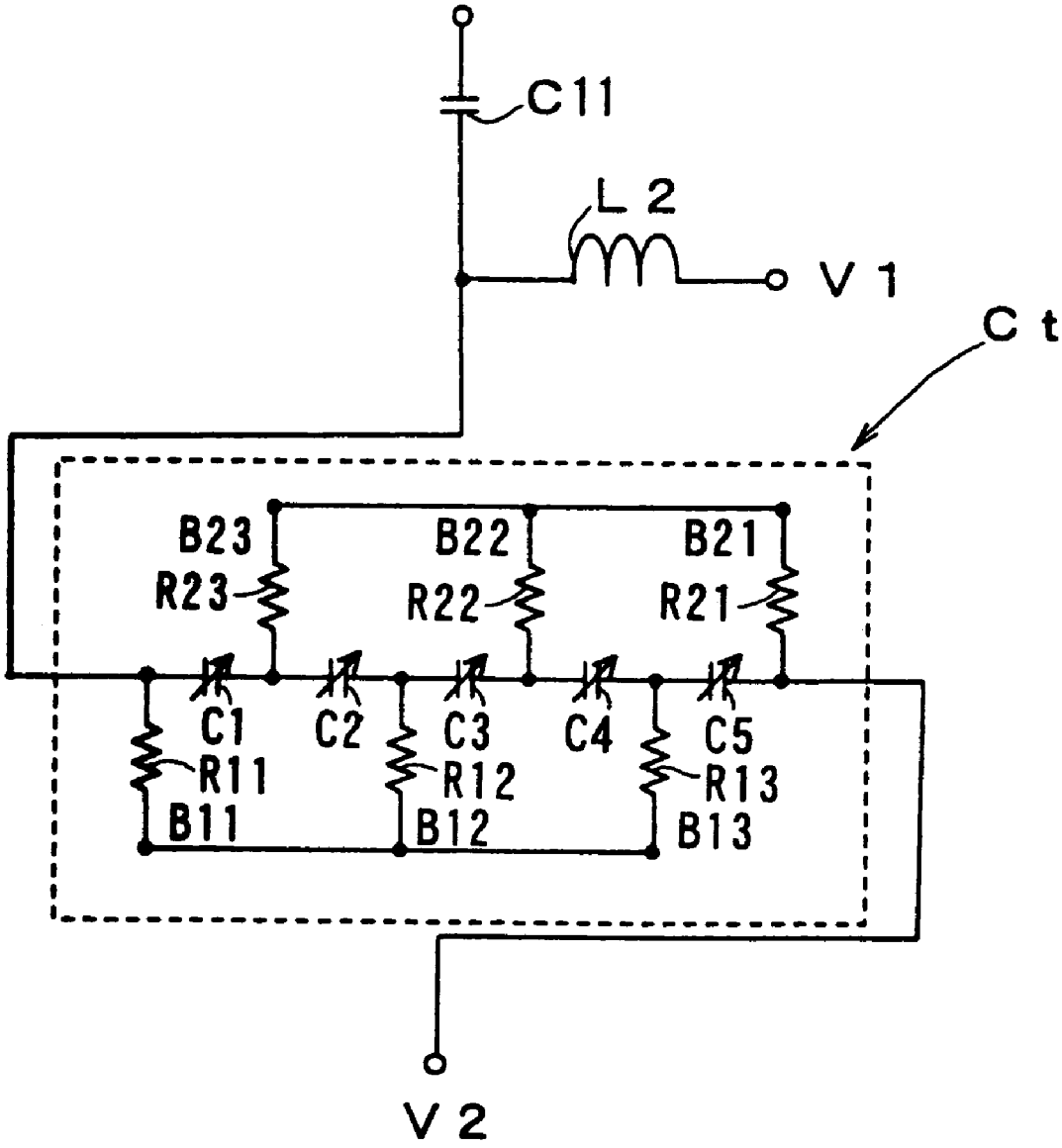
FIG. 2 is an equivalent circuit diagram of a variable capacitance capacitor used in an antenna shown in FIG. 1.
Figure 3:
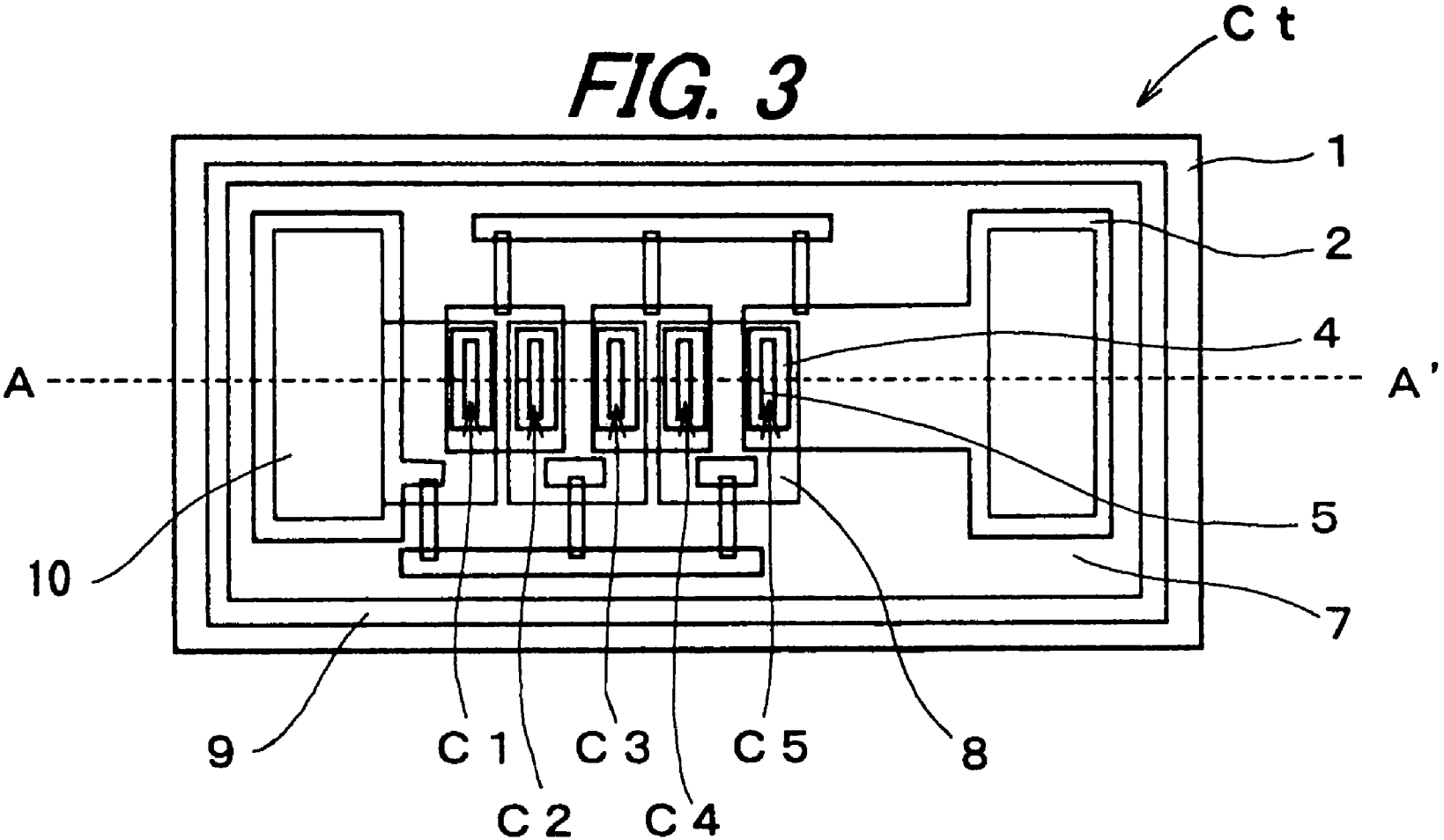
FIG. 3 is a plan view of a sight-through state showing an example of a variable capacitance capacitor including five variable capacitance elements.
Figure 4:
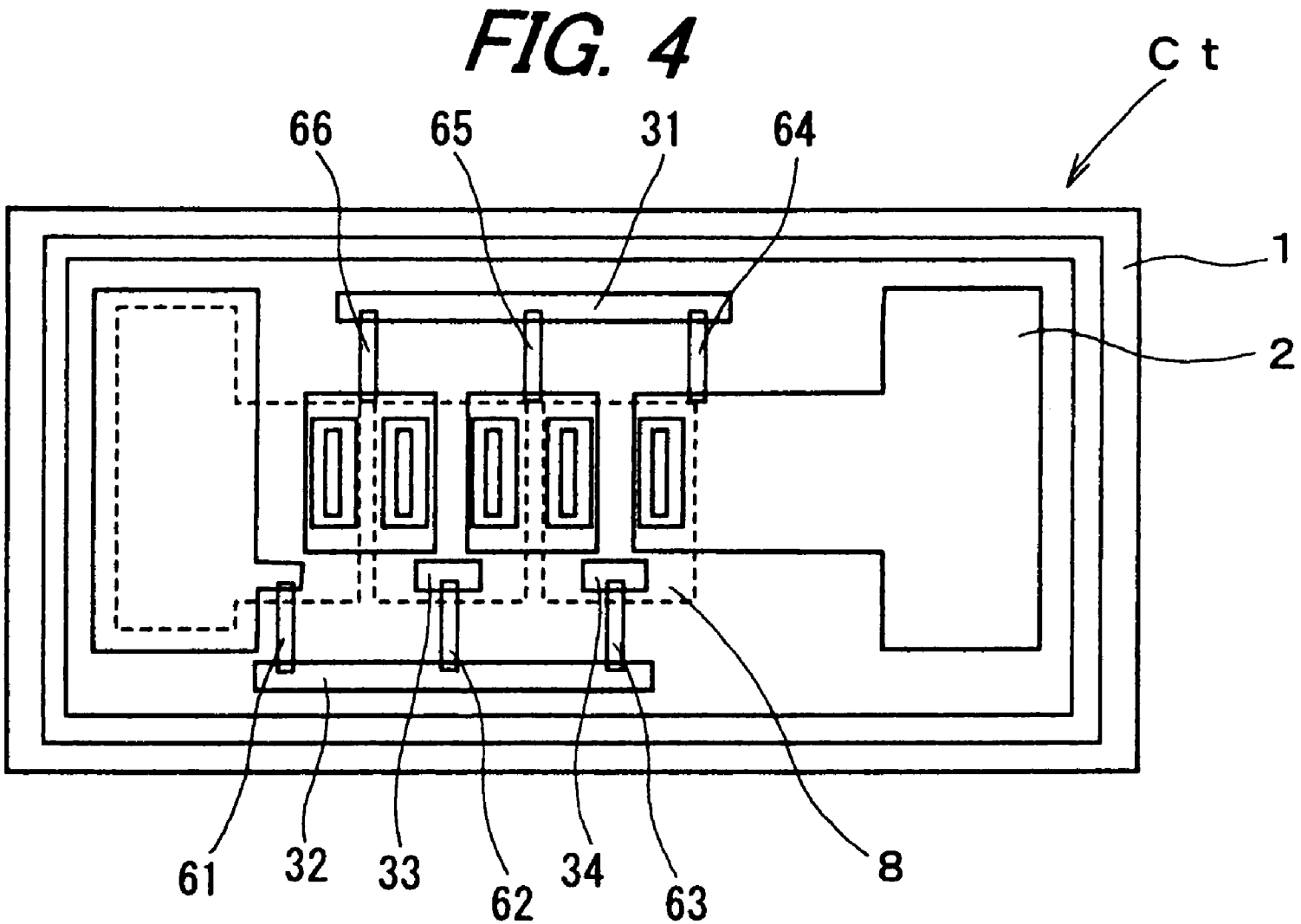
FIG. 4 is a plan view showing a state on the way of producing the variable capacitance capacitor shown in FIG. 3.
Figure 5:
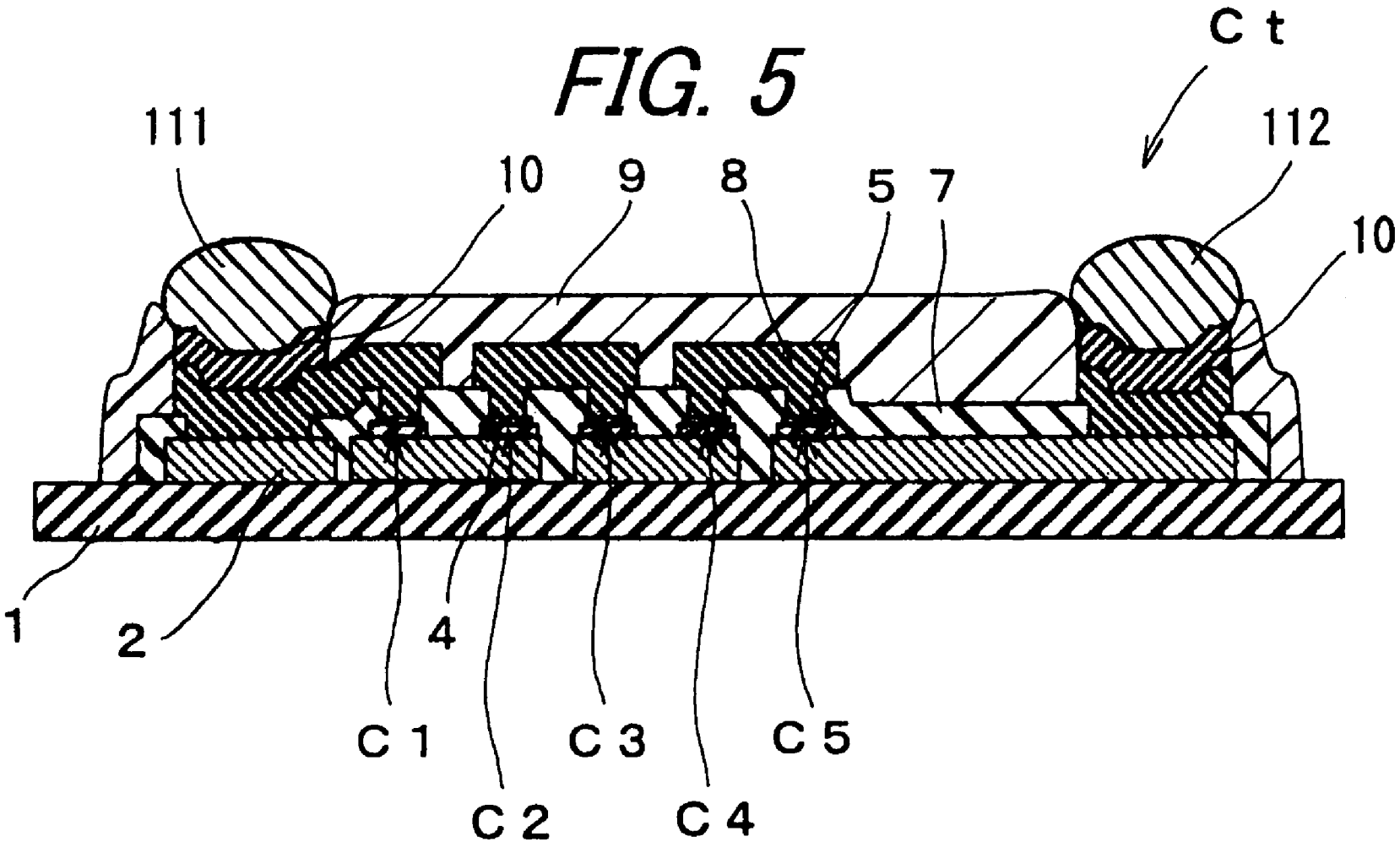
FIG. 5 is a cross-sectional view taken along a line A–A' of FIG. 3.

FIGS. 1 to 5 show an antenna according to a first embodiment of the invention. FIG. 1 is a conceptual view showing an antenna according to the first embodiment of the invention. This example is a frequency variable antenna including an antenna element 11 made of a conductor, a feeding point 12, a ground 13 and a variable capacitance capacitor portion 14. FIG. 2 is an equivalent circuit diagram of the variable capacitance capacitor portion. In the equivalent circuit diagram of FIG. 2, Ct denotes a variable capacitance capacitor. L2 denotes a choke coil including an inductance component for RF blocking for supplying a control voltage (bias signal), and C11 denotes a direct current limiting capacitance element connected to an antenna-element-side terminal. FIGS. 3 to 5 show another example of the variable capacitance capacitor having five variable capacitance elements, and FIG. 3 is a plan view of the variable capacitance capacitor in a sight-through state, FIG. 4 is a plan view showing a state on the way of producing the same, and FIG. 5 is a cross-sectional view taken along a line A–A' of FIG. 3.

In the equivalent circuit diagram of FIG. 2, reference numerals C1, C2, C3, C4, and C5 denote variable capacitance elements, B11, B12 and B13 denote first bias lines including at least one of a resistance component and an inductor component (resistance components R11, R12, and R13 are shown in FIG. 2), and B21, B22 and B23 denote second bias lines including at least one of a resistance component and an inductor component (resistance components R21, R22, and R23 are shown in FIG. 2).

In the variable capacitance capacitor Ct having such a configuration, a high frequency signal flows between an input terminal and an output terminal of the variable capacitance capacitor Ct via the variable capacitance elements C1, C2, C3, C4 and C5 that are connected in series with each other. At this time, the resistance components R11, R12, R13 and R21, R22, R23 of the first bias lines B11, B12, and B13 and the second bias lines B21, B22, and B23 become large impedance components compared to the impedance of the variable capacitance elements C1, C2, C3, C4, and C5 in the frequency region of the high frequency signals, and do not affect adversely the impedance of the high frequency band.

The bias signal that control the capacitance component of the variable capacitance element C1 is supplied from the bias terminal V1 via an inductance L2 and flow to the ground (ground: a bias terminal V2 that also serves as a ground-side terminal in FIG. 2) via the variable capacitance element C1. The variable capacitance element C1 has a predetermined dielectric constant, depending on the voltage to be applied to the variable capacitance element C1, and consequently, a desired capacitance component can be obtained. The variable capacitance elements C2, C3, C4, and C5 are also connected in parallel to each other with regard to direct current component via the first bias lines B11, B12, B13 and the second bias lines B21, B22, B23, and therefore a bias signal having the same size with regard to direct current component is also applied thereto so that a predetermined capacitance component can be obtained.

As a result, a direct current bias signal for controlling the capacitance of the variable capacitance elements C1, C2, C3, C4, and C5 to a desired value can be supplied individually to each of the variable capacitance elements C1, C2, C3, C4, and C5 in a stable manner, and the dielectric constant in a thin film dielectric layer of the variable capacitance elements C1, C2, C3, C4, and C5 that depends on a bias signal applied can be changed as desired. Thus, in the variable capacitance capacitor Ct, the capacitance component can be controlled easily. Consequently, according to the antenna of the invention using the variable capacitance capacitor Ct, the electrical length of the antenna element can be changed and thus the frequency can be matched with a desired frequency.

High frequency signals inputted to the variable capacitance capacitor Ct, that is, high frequency signals inputted to the variable capacitance elements C1, C2, C3, C4 and C5 do not leak via the first bias lines B11, B12, B13 and the second bias lines B21, B22, B23, because the resistance components R11, R12, R13 and R21, R22, R23 become large impedance components compared to the impedance in the frequency region of the high frequency signals. This also makes it possible that a bias signal is applied independently to the variable capacitance elements C1, C2, C3, C4, and C5 in a stable manner. As a result, the capacitance change ratio of each of the variable capacitance elements C1, C2, C3, C4, and C5 that depends on the bias signal can be utilized to the maximum.

In other words, in the variable capacitance capacitor Ct, N variable capacitance elements (N is an integer of 2 or more), herein, five variable capacitance elements C1, C2, C3, C4, and C5 can be regarded as variable capacitance elements connected in series with each other with regard to high frequency component.

Therefore, a high frequency voltage applied to the variable capacitance elements C1, C2, C3, C4, and C5 that are connected in series with each other is divided into each of the variable capacitance elements C1, C2, C3, C4, and C5, so that the high frequency voltage applied to each of the variable capacitance elements C1, C2, C3, C4, and C5 is reduced. Therefore, the capacitance variation with respect to high frequency signals can be suppressed to be small, and in the antenna, the frequency can be changed precisely to a desired frequency, and waveform distortion, intermodulation distortion and the like can be suppressed.

The serial connection of the variable capacitance elements C1, C2, C3, C4, and C5 has the same effect with respect to high frequency as the thickness of the dielectric layer of a capacitance element is increased. Thus, the amount of heat generated per unit volume due to loss resistance of the variable capacitance capacitor Ct can be reduced, and the power handling capability of the antenna can be improved.

When an odd number of variable capacitance elements are used, as in the variable capacitance capacitor Ct shown in FIG. 2, the signal terminal and the bias terminal of the variable capacitance capacitor Ct can be common, so that this can be treated in the same manner as a regular capacitor.

Figure 8:
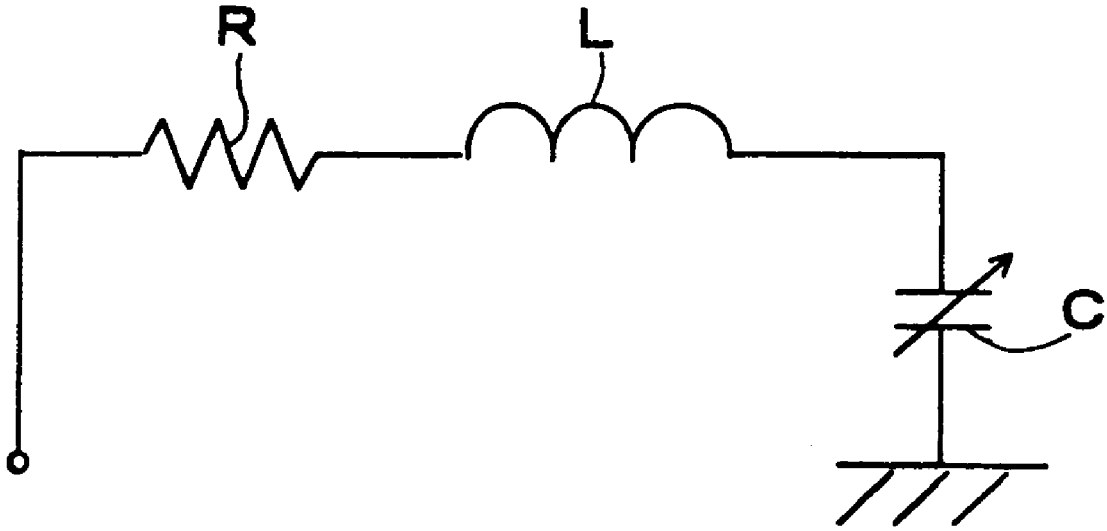
FIG. 8 is an equivalent circuit diagram showing the concept of a frequency variable antenna.

Here, the fact that the frequency can be varied with the antenna of the invention will be described, using the equivalent circuit diagram showing the concept of the frequency variable antenna of FIG. 8. For example, in the operating frequency of a reverse L-shaped antenna, a resonance occurs in which the current flowing the antenna element is large in the vicinity of the feeding terminal (portion shown by a circle on the left side in FIG. 8), and becomes smaller toward the end portion (the ground portion on the right side in FIG. 8) of the element. In the equivalent circuit, an inductance L is shown in the vicinity of the feeding terminal and a capacitance C is shown in the end portion of the element, and a portion contributing to the loss due to radiation is shown as a radiation resistance R. The operating frequency of the antenna is expressed by a value obtained by dividing the square root of the inverse of the product of the inductance L and the capacitance C by the product of 2 and the ratio of the circumference of a circle to its diameter. Therefore, the operating frequency of the antenna can be varied by varying the value of the capacitance C by using the variable capacitance capacitor Ct, and in the antenna of the invention, the frequency is variable based on this principle.

Next, an example of a method for producing a variable capacitance capacitor Ct constituting the antenna of the invention will be described.

Regarding the variable capacitance capacitor Ct in the antenna of the invention, FIG. 3 is a plan view of a sight-through state showing an example of a variable capacitance capacitor Ct including five variable capacitance elements C1 to C5. FIG. 4 is a plan view showing a state on the way of producing the variable capacitance capacitor Ct shown in FIG. 3. FIG. 5 is a cross-sectional view taken along a line A–A' of the variable capacitance capacitor Ct shown in FIG. 3.

In FIGS. 3 to 5, the variable capacitance capacitor includes a support substrate 1, a lower electrode layer 2, conductor lines 31, 32, 33, and 34, a thin film dielectric layer 4, an upper electrode layer 5, thin film resistors 61, 62, 63, 64, 65 and 66, an insulating layer 7, an extraction electrode layer 8, a protective layer 9, and a solder diffusion preventing layer 10. The solder diffusion preventing layer 10 and the solder terminal portion 111 constitutes a first signal terminal (input terminal), and the solder diffusion preventing layer 10 and the solder terminal portion 112 constitutes a second signal terminal (output terminal).

The support substrate 1 is a ceramic substrate such as alumina ceramics, a monocrystal substrate such as sapphire, or the like. On this support substrate 1, the lower electrode layer 2, the thin film dielectric layer 4 and the upper electrode layer 5 are formed sequentially on the substantially entire surface of the support substrate 1. After these layers are formed, the upper electrode layer 5, the thin film dielectric layer 4 and the lower electrode layer 2 are etched sequentially to predetermined shapes.

The lower electrode layer 2 has to have a high melting point so as to be resistant to high temperatures, because high temperature sputtering is necessary in order to form the thin film dielectric layer 4. More specifically, the lower electrode layer 2 is made of a metal material such as Pt, and Pd. The lower electrode layer 2 is also formed by high temperature sputtering. Furthermore, after formed by high sputtering, the lower electrode layer 2 is heated to 700 to 900° C., which is the sputtering temperature of the thin film dielectric layer 4, and maintained for a predetermined time until the start of the sputtering of the thin film dielectric layer 4 so that the lower electrode layer 2 can be smooth.

It is preferable that the thickness of the lower electrode layer 2 is large, in view of the resistance component from the second signal terminal to the fifth variable capacitance element C5, resistance components from the first variable capacitance element C1 to the second variable capacitance element C2, from the third variable capacitance element C3 to the fourth variable capacitance element C4, and the continuity of the lower electrode layer 2. However, in view of the adhesiveness with the support substrate 1, it is preferable that the thickness is relatively small. Thus, these two factors are taken into consideration to determine the thickness. More specifically, the thickness is preferably 0.1 μm to 10 μm. When the thickness of the lower electrode layer 2 is smaller than 0.1 μm, the resistance of the lower electrode layer 2 itself becomes large, and the continuity of the lower electrode layer 2 may not be ensured. On the other hand, when the thickness is larger than 10 μm, the internal stress becomes large, and the adhesiveness with the support substrate 1 is reduced or the curvature of the support substrate 1 may occur.

It is preferable that the thin film dielectric layer 4 is a dielectric layer having high dielectric constant made of a perovskite oxide crystal containing at least Ba, Sr, and Ti. The thin film dielectric layer 4 is formed on the surface (upper surface) of the lower electrode layer 2. For example, sputtering is performed until a film having a desired thickness can be obtained, using a dielectric material that can provide a perovskite oxide crystal as a target. At this time, when high temperature sputtering is performed at a high substrate temperature, for example, at 800° C., a thin film dielectric layer 4 having a high dielectric constant, a large capacitance change ratio and low loss can be obtained without performing a heat treatment after sputtering.

As the material of the upper electrode layer 5, Au, which has a small resistivity, is preferable in order to reduce the resistance of this layer. However, in order to improve the adhesiveness with the thin film dielectric layer 4, it is preferable to use Pt or the like as an adhesive layer. The thickness of the upper electrode layer 5 is 0.1 μm to 10 μm. The lower limit of the thickness thereof is set in view of the resistance of the upper electrode layer 5 itself, as in the lower electrode layer 2. The upper limit of the thickness is set in view of the adhesiveness with the thin film dielectric layer 4.

The first bias lines B11, B12, B13 constituting a bias supply circuit are composed of the conductor lines 32, 33, 34 and the thin film resistors 61, 62, 63. The first bias lines B11, B12, B13 are formed from a first bias terminal (also serving as the first signal terminal) to a connection point of the first bias terminal and the first variable capacitance element C1; to a connection point of the second variable capacitance element C2 and the third variable capacitance element C3, that is, the extraction electrode layer 8 connecting the upper electrode layer 5 of the second variable capacitance element C2 and the upper electrode layer 5 of the third variable capacitance element C3; and to a connection point of the fourth variable capacitance element C4 and the fifth variable capacitance element C5, that is, the extraction electrode layer 8 connecting the upper electrode layer 5 of the fourth variable capacitance element C4 and the upper electrode layer 5 of the fifth variable capacitance element C5, respectively.

More specifically, in the first bias lines B11, B12, B13, the first bias terminal and the conductor line 32 are connected each other by the thin film resistor 61. The conductor line 32 and the conductor line 33 are connected each other by the thin film resistor 62. The conductor line 33 is connected to the extraction electrode layer 8 connecting the upper electrode layer 5 of the second variable capacitance element C2 and the upper electrode layer 5 of the third variable capacitance element C3. The conductor line 32 and the conductor line 34 are connected each other by the thin film resistor 63. The conductor line 34 is connected to the extraction electrode layer 8 connecting the upper electrode layer 5 of the fourth variable capacitance element C4 and the upper electrode layer 5 of the fifth variable capacitance element C5.

Similarly, The second bias lines B21, B22, B23 are constituted by the conductor line 31 and the thin film resistors 64, 65, 66. The second bias lines B21, B22, B23 are formed from a second bias terminal (also serving as the second signal terminal) to a connection point of the second bias terminal and the fifth variable capacitance element C5; to a connection point of the third variable capacitance element C3 and the fourth variable capacitance element C4; and to a connection point of the first variable capacitance element C1 and the second variable capacitance element C2, respectively.

More specifically, in the second bias lines B21, B22, B23, the second bias terminal and the conductor line 31 are connected each other by the thin film resistor 64. The conductor line 31 and the connection point of the third variable capacitance element C3 and the fourth variable capacitance element C4 are connected each other by the thin film resistor 65. The conductor line 31 and the connection point of the first variable capacitance element C1 and the second variable capacitance element C2 are connected each other by the thin film resistor 66.

The conductor lines 31, 32, 33, and 34 can be formed by a new film-forming operation after the lower electrode layer 2, the thin film dielectric layer 4 and the upper electrode layer 5 described above are formed. In this case, it is preferable to use a lift off technology in order to protect the lower electrode layer 2, and the thin film dielectric layer 4 and the upper electrode layer 5 that already have been formed. The conductor lines 31 to 34 also can be formed by pattering so as to form the conductor lines 31 to 34 at the same time when the lower electrode layer 2 is patterned.

As the material of the conductor lines 31 to 34, Au, which has a low resistance, is preferable in order to suppress a variation of the resistance of the first and the second bias lines B11, B12, B13, B21, B22, and B23. However, since the resistance of the thin film resistors 61, 62, 63, 64, 65 and 66 is sufficiently high, the conductor lines may be formed in the same process and with the same material as the lower electrode layer 2, using Pt or the like.

Then, as the material of the thin resistors 61 to 66 constituting the first and the second bias lines B11, B12, B13, B21, B22, and B23, a material containing tantalum (Ta) and having a specific resistance of 1 mΩ·cm or more is preferable. Specific examples thereof include tantalum nitride (TaN), TaSiN, Ta—Si—O. For example, in the case of tantalum nitride, the thin film resistors 61 to 66 having a desired composition ratio and resistivity can be formed by reactive sputtering in which sputtering is performed with nitrogen added, using Ta as a target.

By selecting the condition of the sputtering as appropriate, the thin film resistors 61 to 66 having a thickness of 40 nm or more and a specific resistance of 1 mΩ·cm or more can be formed. Furthermore, after the sputtering ends, patterning can be performed in a simple manner by performing an etching process such as reactive ion etching (RIE) after a resist is applied and processed to a predetermined shape.

When the variable capacitance capacitor Ct is used at a frequency of 1 GHz, the capacitance of the variable capacitance elements C1 to C5 is set to 5 pF, and the thin film resistors 61 to 66 are set to have a resistance at least 10 times as large as the impedance at 100 MHz of the variable capacitance elements C1 to C5 so the impedance is not adversely affected from at least 1/10 (100 MHz) of this frequency, then it is sufficient that the necessary resistance of the first and the second bias lines B11, B12, B13, B21, B22, and B23 is about 3.2 kΩ or more. When the specific resistivity of the thin film resistors 61 to 66 in the variable capacitance capacitor Ct is 1 mΩ·cm or more, and 10 kΩ is to be obtained as the resistance of the first and the second bias lines B11, B12, B13, B21, B22, and B23, then the aspect ratio (length/width) of the thin film resistors 61 to 66 can be 50 or less at a thickness of 50 nm. Therefore, the thin film resistors 61 to 66 can have a realizable aspect ratio without increasing the size of the element shape.

The first and the second bias lines B11, B12, B13, B21, B22, and B23 including the thin film resistors 61 to 66 are formed directly on the support substrate 1. Therefore, an insulating layer for ensuring the insulation with the lower electrode layer 2, the upper electrode layer 5 and the extraction electrode layer 8, which is necessary in the case of formation on the variable capacitance elements C1 to C5, is not necessary, and the number of the layers constituting the variable capacitance elements C1 to C5 can be reduced. Furthermore, by using the thin film resistors 61 to 66 having a high resistance, the variable capacitance capacitor Ct can be produced without increasing the size of its shape.

Then, an insulting layer 7 is necessary to ensure insulation with the extraction electrode layer 8 and the lower electrode layer 2 that are to be formed thereon. Furthermore, the insulating layer 7 covers the first and the second bias lines B11, B12, B13, B21, B22, and B23, and can prevent the thin film resistors 61 to 66 from being oxidized. Therefore, the resistance of the first and the second bias lines B11, B12, B13, B21, B22, and B23 can be made constant over time, and thus reliability can be improved. The material of the insulating layer 7 preferably contains at least one selected from silicon nitride and silicon oxide in order to improve moisture resistance. It is preferable to form the insulating layer by chemical vapor deposition (CVD) or the like in view of coatability.

The insulating layer 7 can be processed to a desired shape by dry etching using a regular resist. The insulating layer 7 is provided with through-holes reaching the conductor lines 33, 34 in order to establish a connection between the thin film resistors 61 to 66 and the extraction electrode layer 8. It is preferable that in view of improvement of moisture resistance that other than the through-holes, only the upper electrode layer 5 and the solder terminal portions 111 and 112 are exposed from the insulating layer 7.

Then, the extraction electrode layer 8 connects the upper electrode layer 5 of the first variable capacitance element C1 and the terminal forming portion 111 on one hand, and connects the two upper electrode layers 5 so that the second variable capacitance element C2 and the third variable capacitance element C3 are connected in series with each other, and the fourth variable capacitance element C4 and the fifth variable capacitance element C5 are connected in series with each other. Furthermore, the extraction electrode layers 8 extending across the variable capacitance elements C2 and C3 and across the variable capacitance elements C4 and C5 are connected to the conductor lines 33 and 34 through the through-holes of the insulating layer 7, respectively. As the material of the extraction electrode layer 8, it is preferable to use a metal having a low resistance such as Au and Cu. An adhesive layer made of Ti, Ni or the like may be used, in view of the adhesiveness between the extraction electrode layer 8 and the insulating layer 7.

Then, a protective layer 9 is formed so as to cover the whole with the solder terminal portions 111 and 112 exposed. The protective layer 9 serves to protect the components of the variable capacitance capacitor Ct including the variable capacitance element C1 mechanically and from contamination due to chemicals or the like. However, when forming the protective layer 9, formation is performed such that the solder terminal portions 111, 112 are exposed. As the material of the protective layer 9, a material having high heat resistance and excellent coatability with respect to steps is preferable. Specific examples thereof include polyimide resin and BCB (benzocyclobutene) resin and the like. The protective layer 9 can be formed by applying raw materials of resin and curing the materials at a predetermined temperature.

The solder diffusion preventing layer 10 is formed to prevent the solder of the solder terminal portions 111, 112 from being diffused to the lower electrode layer 2 at the time of reflow when forming the solder terminal portions 111, 112 or mounting. As the material of the solder diffusion preventing layer 10, Ni is preferable. Au, Cu or other substances having high wettability with solder may be formed to a thickness of about 0.1 μm on the surface of the solder diffusion preventing layer 10 in order to improve the solder wettability.

Finally, the solder terminal portions 111 and 112 are formed. The solder terminal portions are formed to facilitate mounting to a wiring board outside the variable capacitance capacitor Ct. In general, the solder terminal portions 111 and 112 are formed by printing a solder paste on a portion where the solder terminal portions 111 and 112 are to be formed, using a predetermined mask and then performing reflow.

According to the variable capacitance capacitor Ct described above, the thin film resistors 61 to 66 containing tantalum nitride and having a specific resistance of 1 mΩ·cm or more is used in the first and the second bias lines B11, B12, B13, B21, B22, and B23 or a portion thereof, so that the aspect ratio of the thin film resistors 61 to 66 is reduced and thus a compact variable capacitance capacitor Ct is realized. Furthermore, the first and the second bias lines B11, B12, B13, B21, B22, and B23 are formed directly on the support substrate 1, so that the number of the layers constituting each element such as the variable capacitance elements C1 is reduced. Moreover, since the process of forming the conductor layer, the dielectric layer and other layers constituting each element is performed in common with other elements, the variable capacitance capacitor can be formed in a simply manner, although the configuration is relatively complex.

According to the invention, the variable capacitance capacitor portion 14 using the variable capacitance capacitor Ct produced as above is connected between the antenna element 11 and the ground 13. Therefore, the capacitance formed between the antenna element 11 and the ground 13 is added with the capacitance component by the variable capacitance capacitor portion 14, so that the operating frequency of the antenna can be varied by changing the capacitance of the variable capacitance capacitor portion 14.

Then, a wireless communication apparatus (not shown) of the invention includes the antenna of the invention as described above, and at least one of a transmitting circuit and a receiving circuit, the one being connected to the antenna. Furthermore, a wireless signal processing circuit may be connected to the antenna, the transmitting circuit or the receiving circuit in order to allow wireless communication, as desired, or other various configuration can be used.

According to such a wireless communication apparatus of the invention, since the antenna of the invention as above and at least one of the transmitting circuit or the receiving circuit corresponding to a wireless signal of various different frequency bands, the one being connected to the antenna, are included, a compact, high performance and frequency variable wireless communication apparatus that is operable at various different frequencies with one antenna that can be of low height and small size can be provided.

Figure 6:
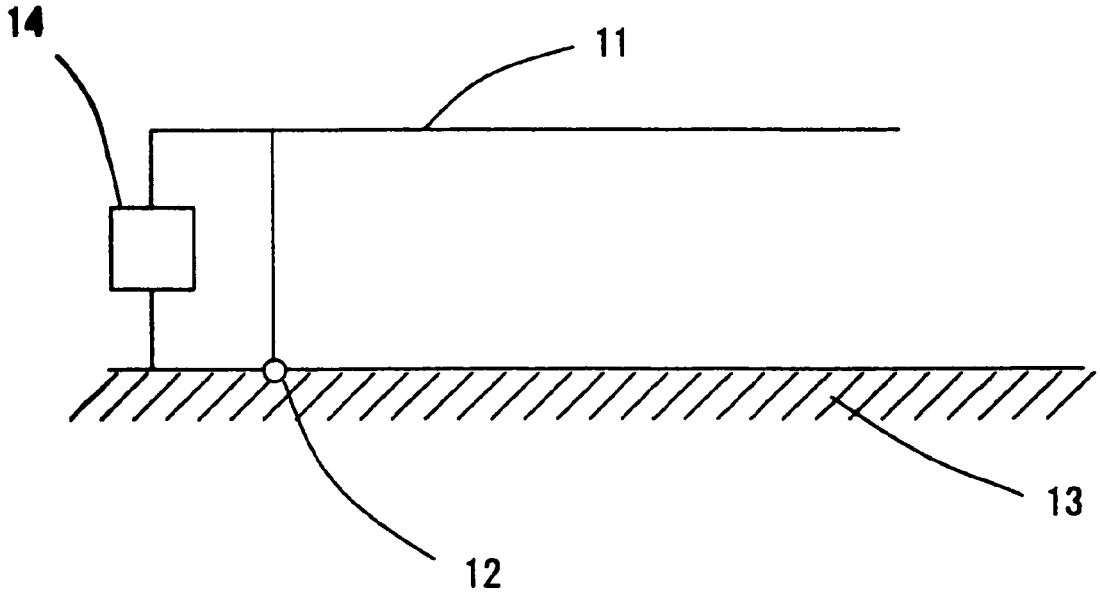
FIG. 6 is a conceptual view showing an antenna according to a second embodiment of the invention.

The invention is not limited to the embodiment examples as described above, and various modification can be added to the invention within the range that does not depart from the gist of the invention. For example, in an example of the embodiment, a reverse L-shaped antenna is used as the antenna element 11, but as an antenna according to a second embodiment of the invention shown in FIG. 6 by the same concept diagram as FIG. 1, a frequency variable antenna can be used in which a reverse F-shaped antenna element is used as the antenna element 11, and the variable capacitance capacitor portion 14 is connected between the antenna element 11 and the ground 13. In the case of such an example, the input impedance of the antenna can be adjusted with the feeding position, and thus an antenna whose impedance matching is easily performed can be provided.

Figure 7:
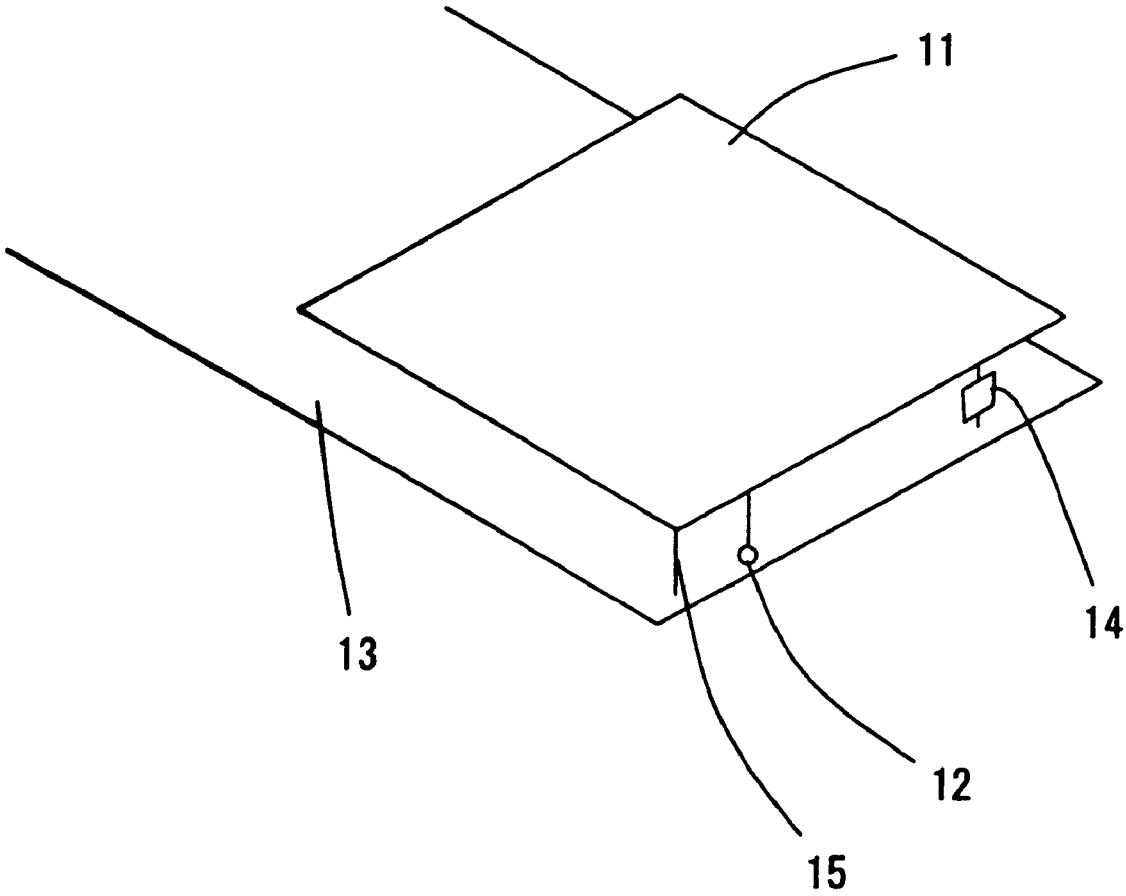
FIG. 7 is a perspective view as a conceptual view showing an antenna according to a third embodiment of the invention.

Furthermore, as an antenna according to a third embodiment of the invention whose perspective view is shown in FIG. 7 as a concept diagram, a frequency variable antenna can be used in which a planar reverse F-shaped antenna element is used as the antenna element 11, and the variable capacitance capacitor portion 14 having the variable capacitance capacitor Ct is connected between the antenna element 11 and the ground 13. In FIG. 7, reference numeral 15 denotes a short pin. In the case of such an example, when this configuration is used for the main antenna for mobile telephones, the influence on the human body is small, and the configuration of the invention makes it possible that a planar reverse F-antenna, which has relatively narrow band characteristics, can be used as an antenna operable at multiple frequencies.

Furthermore, in the embodiment examples as above, the first bias lines B11, B12 and B13, and the second bias lines B21, B22 and B23 constituting a bias supply circuit are provided between common bias terminals V1 and V2 as common bias lines. However, a variable capacitance capacitor Ct can have a configuration in which the bias lines B11, B12 B13, B21, B22 and B23 constituting a bias supply circuit can be individually provided with respect to the variable capacitance elements C1, C2, C3, C4, and C5. The variable capacitance capacitor portion 14 can have this variable capacitance capacitor Ct.

Figure 9:
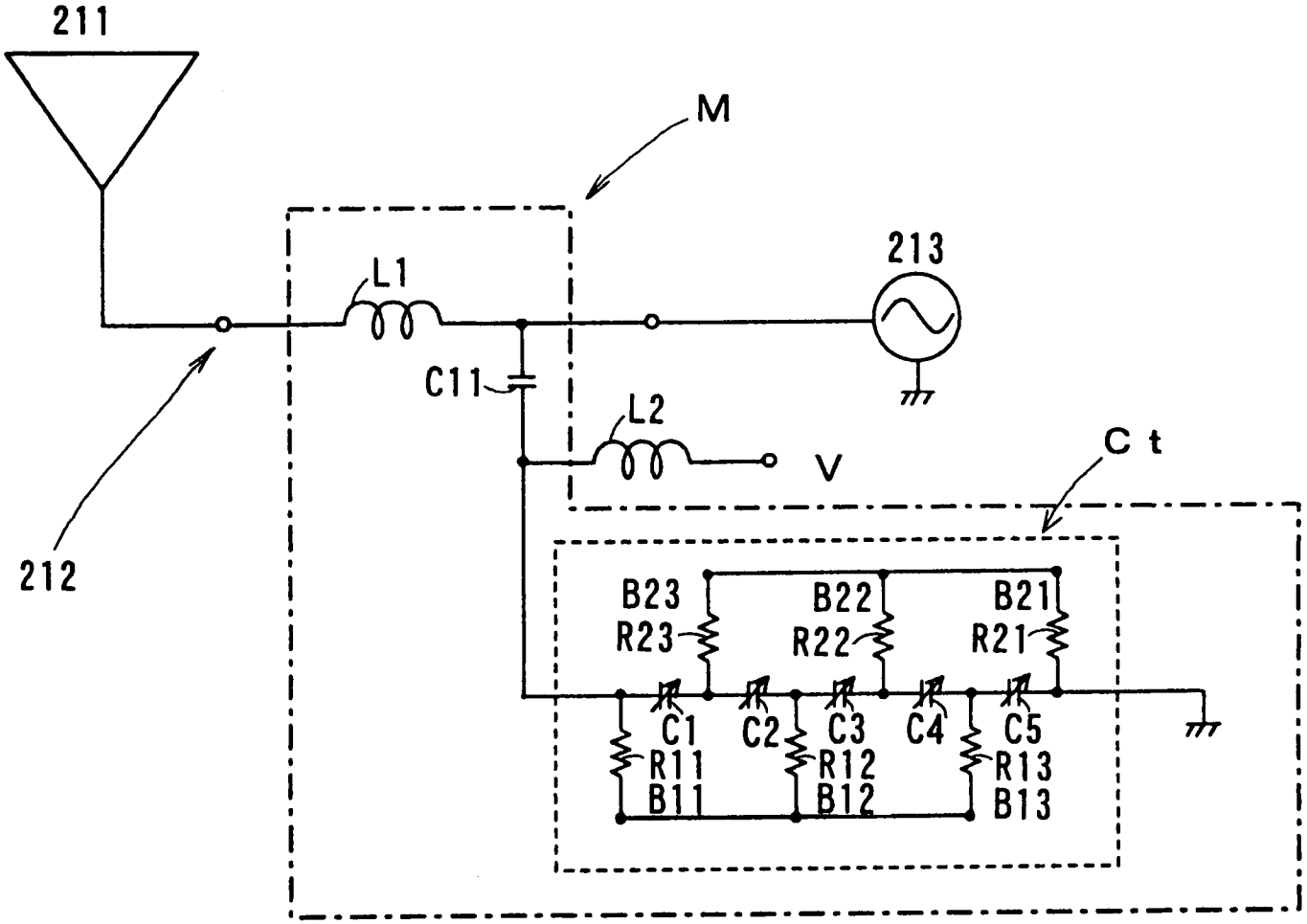
FIG. 9 is an equivalent circuit diagram showing an antenna according to a fourth embodiment of the invention.

FIG. 9 shows an antenna according to a fourth embodiment of the invention. FIG. 9 is an equivalent circuit diagram of an antenna device using an LC lowpass type variable matching circuit having five variable capacitance capacitors.

In the equivalent circuit diagram shown in FIG. 9, the antenna includes an antenna element 211 and a variable matching circuit M. One end of the variable matching circuit M is connected to a feeding terminal 212. Further, one end of a feeding power source 213 is connected to another end of the variable matching circuit M, and another end of the feeding power source 213 is connected to the ground. In the variable matching circuit M, L1 denotes an inductor, which is an impedance element, and one end of the inductor L1 is connected to the feeding terminal 212 in series, and another end of the inductor L1 is connected to the feeding power source 213 and one end of a capacitance element C11. The capacitance element C11 is set as a direct current limiting capacitance element. L2 denotes a choke coil including an inductance component for RF blocking for supplying a control voltage (bias signal), and Ct denotes a variable capacitance capacitor. Another end of the capacitance element C11 is connected to one end of the choke coil L2 and one end of the variable capacitance capacitor Ct. Another end of the choke coil L2 is connected to a bias terminal V, and another end of the variable capacitance capacitor Ct is connected to the ground.

By connecting the variable matching circuit M having the variable capacitance capacitor Ct between the feeding terminal 212 of the antenna element 211 and the feeding power source 213 in this manner, the capacitance component of the antenna can be adjusted, and the operating frequency of the antenna is changed to a desired frequency.

Here, an example in which the variable matching circuit M is an LC lowpass type is shown, but the configuration of the variable matching circuit M can be modified to, for example, LC highpass type, π type, T type, or a multistage configuration that has the variable capacitance capacitor Ct, depending on the purpose, and the same effect can be obtained with any variable matching circuit, as long as the configuration does not depart from the gist of the invention.

As the antenna element 211, a commonly used antenna such as a linear antenna or planar antenna can be used. In particular, a whip antenna, which is used in recent portable equipment such as mobile telephones, a microstrip antenna, which can be built in a housing, a plate-like reverse F antenna or the like can be used. In particular, the microstrip antenna and the plate-like reverse F antenna are advantageous in terms of compactness. A compact antenna element 211 can be obtained by, for example, forming a conductor material for serving as a radiation electrode on a substrate made of a dielectric such ass ceramics or organic materials or a magnetic substance such as ferrite by a pressure joint method, pressing, plating, printing or the like. Furthermore, an antenna element having a narrow bandwidth can be used as the antenna element 211, and it is possible to consider a reduction of the bandwidth due to a reduction of the size.

Furthermore, the variable capacitance capacitor Ct is the same as the variable capacitance capacitor Ct of the above-mentioned embodiment, and the overlapping description thereof will be omitted.

In the embodiment, the characteristic impedance of the variable matching circuit M can be set to a desired characteristic impedance by the variable capacitance capacitor Ct, and in the antenna of the invention in which the variable matching circuit M using the variable capacitance capacitor is connected between the feeding terminal 212 of the antenna element 211 and the feeding power source 213, the operating frequency of the antenna can be adjusted as desired by the variable matching circuit M.

Figure 10:
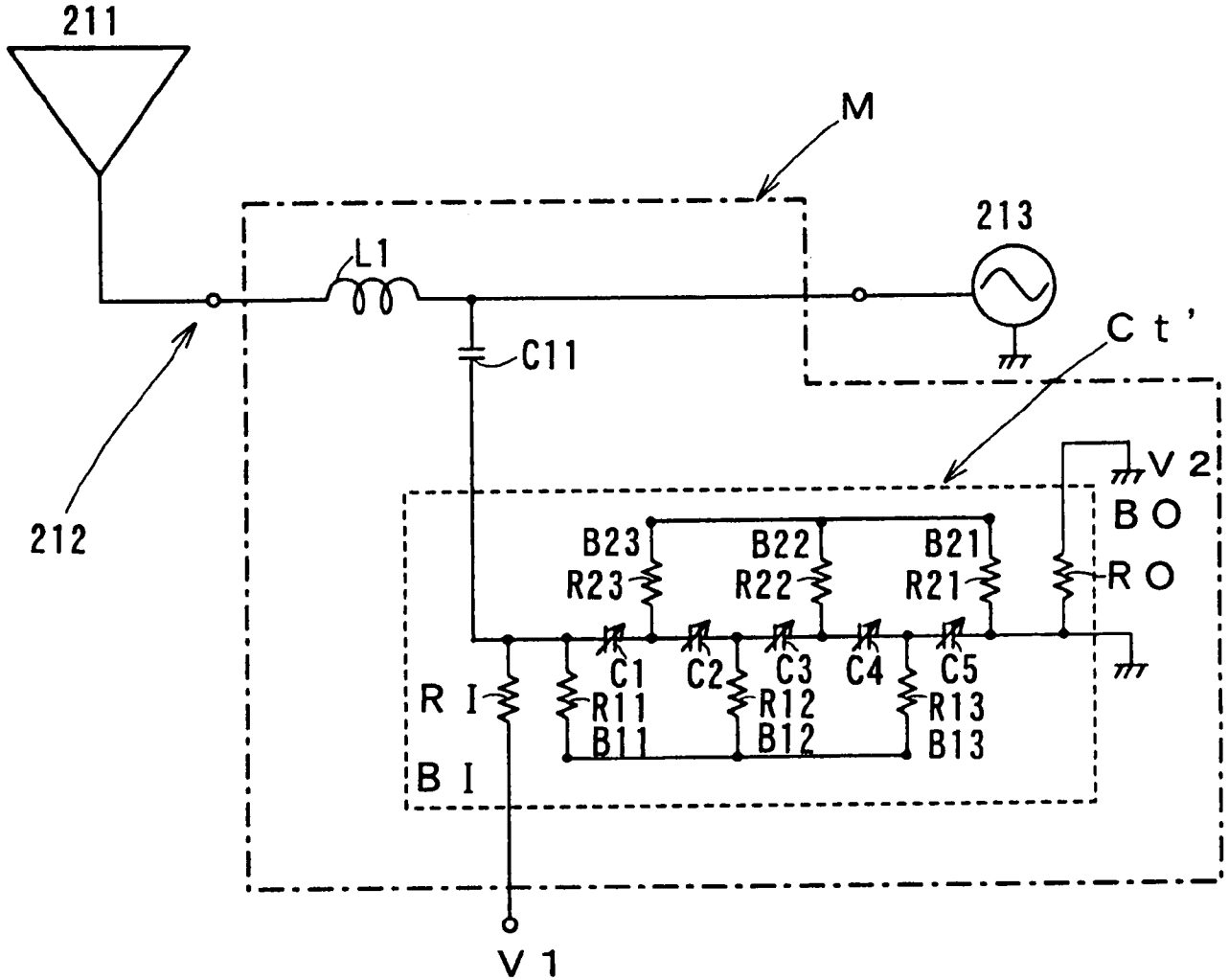
FIG. 10 is an equivalent circuit diagram showing an antenna according to a fifth embodiment of the invention.
Figure 11:
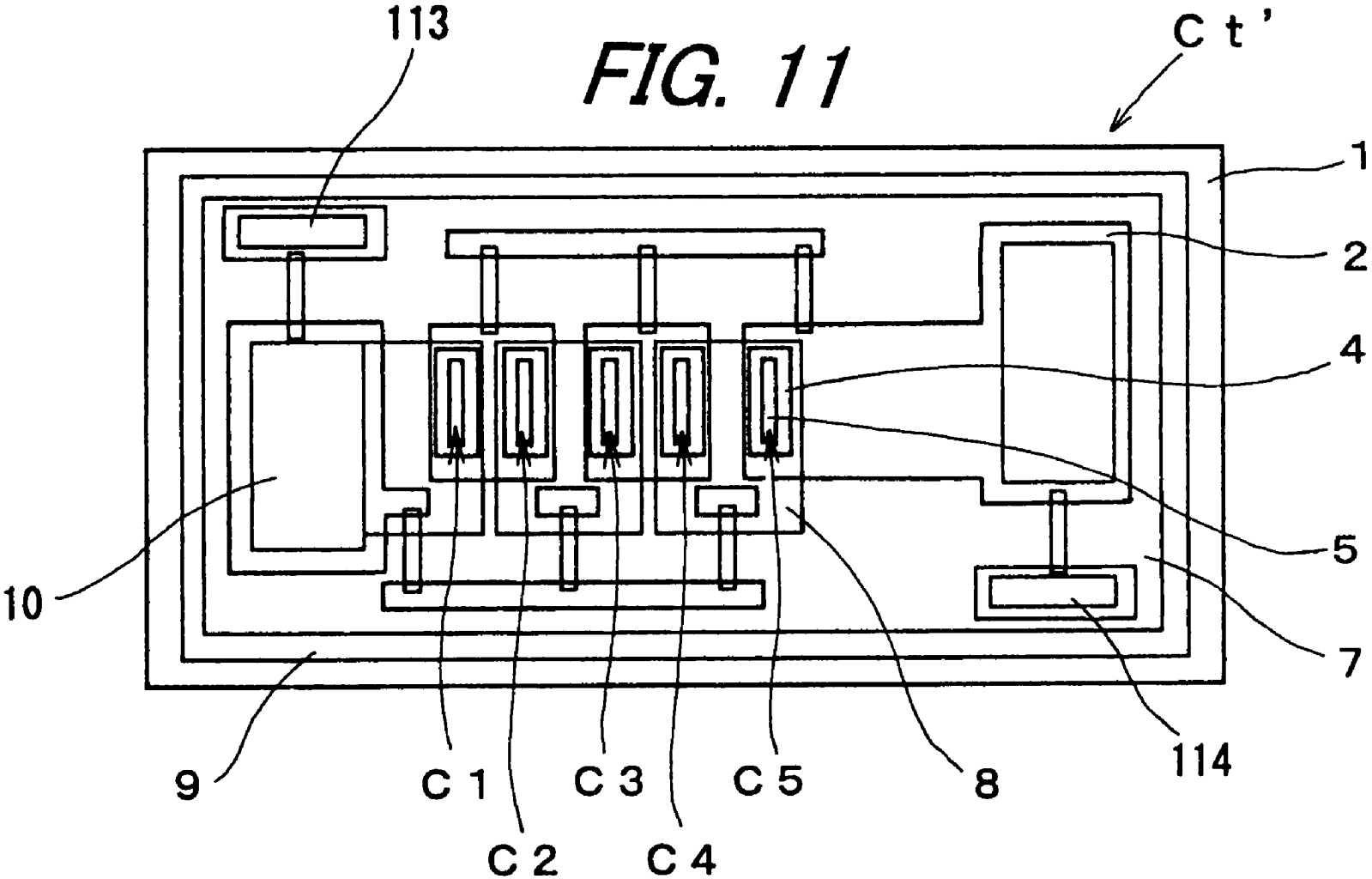
FIG. 11 is a plan view of a sight-through state showing an example of a variable capacitance capacitor including a bias supply circuit.
Figure 12:
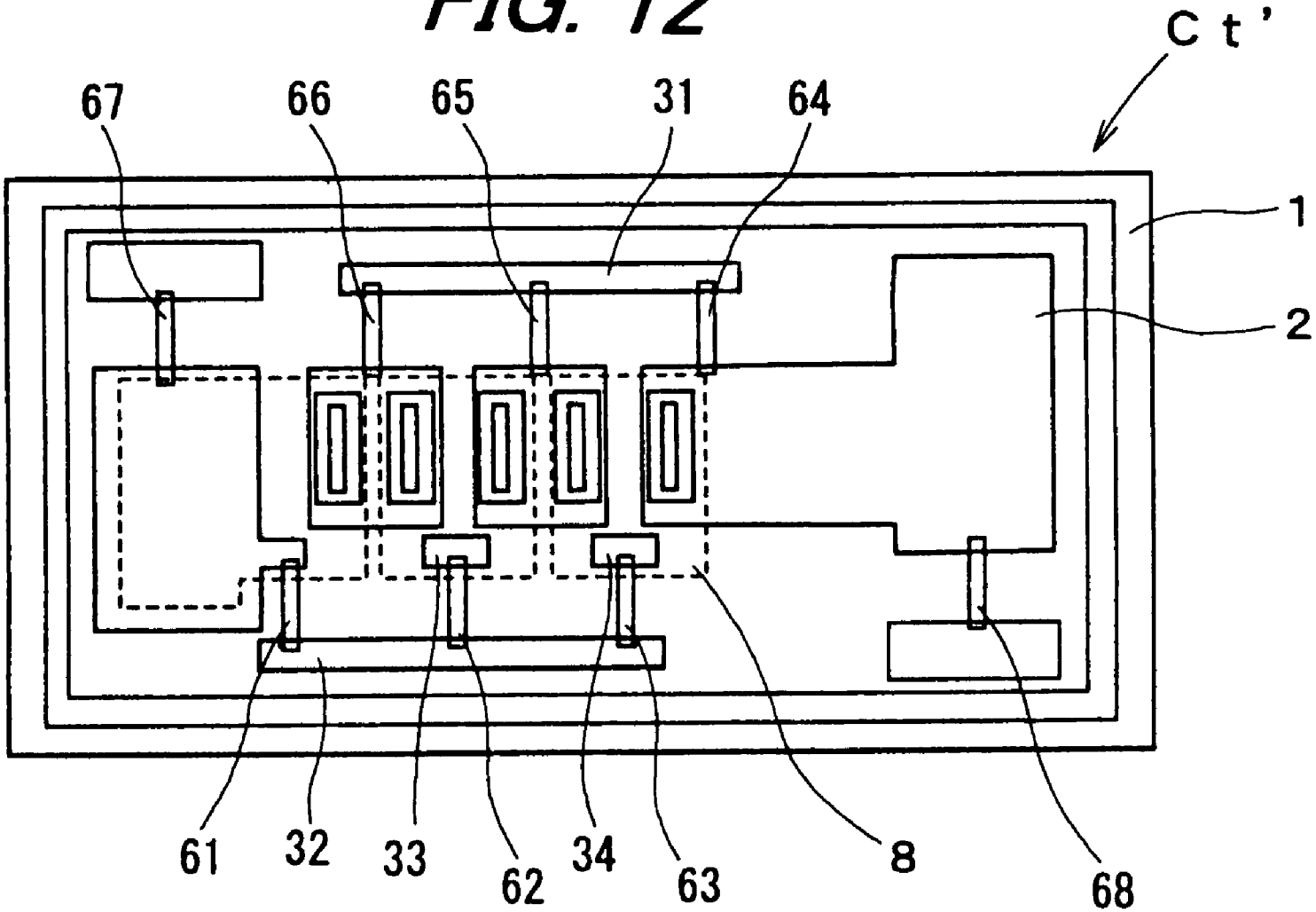
FIG. 12 is a plan view showing a state on the way of producing the variable capacitance capacitor shown in FIG. 11.

FIGS. 10 to 12 show the antenna according to a fifth embodiment of the invention. FIG. 10 is an equivalent circuit diagram of an LC lowpass type variable matching circuit portion using a variable capacitance capacitor having five variable capacitance elements which variable capacitance capacitor has a bias circuit, and FIGS. 11 and 12 show a plan view of a sight-through state and a plan view showing a state on the way of production of an example of the variable capacitance capacitor having the bias supply circuit. In these drawings, the same portions as in FIGS. 3 to 5 and 19 are denoted by the same reference numerals, and the overlapping description thereof will be omitted.

In an equivalent circuit diagram shown in FIG. 10, reference numerals C1, C2, C3, C4, and C5 denote variable capacitance elements, B11, B12, and B13 denote first bias lines including at least one of a resistance component and an inductor component (resistance components R11, R12, and R13 are shown in FIG. 10), and B21, B22 and B23 denote second bias lines including at least one of a resistance component and an inductor component (resistance components R21, R22, and R23 are shown in FIG. 10). BI and BO denote first and second common bias lines, which are bias supply circuits including at least one of a resistance component and an inductor component (resistance components RI and RO are shown in FIG. 10). V1 denotes a first bias terminal, that is, a terminal on a side from which a bias signal is supplied, and V2 denotes a second bias terminal, that is, a terminal from which the bias signal applied to the variable capacitance elements C1, C2, C3, C4 and C5 is sent off to the ground.

In the variable capacitance capacitor Ct' having such a configuration, a high frequency signal flows between the input terminal and the output terminal of the variable capacitance capacitor Ct' via the variable capacitance elements C1, C2, C3, C4 and C5 that are connected in series with each other. At this time, the resistance components R11, R12, R13 of the first bias lines B11, B12, B13 and the resistance components R21, R22, R23 of the second bias lines B21, B22, and B23 become large impedance components compared to the impedance of the variable capacitance elements C1, C2, C3, C4, and C5 in the frequency region of the high frequency signals, and do not affect adversely the impedance of the high frequency band.

Furthermore, the resistance component RI of the first common bias line BI and the resistance components RO of the second common bias line BO become large impedance components compared to the impedance of the combined capacitance of the variable capacitance elements C1 to C5 in the frequency region of high frequency signals, and do not affect adversely the impedance of the high frequency band.

The bias signals that control the capacitance component of the variable capacitance capacitor Ct' are supplied from the first bias terminal V1 and flow to the second bias terminal V2 (ground in FIG. 5) via the variable capacitance element C1. The variable capacitance element C1 has a predetermined dielectric constant, depending on the voltage to be applied to the variable capacitance element C1, and consequently, a desired capacitance component can be obtained. The same applies to the variable capacitance elements C2 to C5.

As a result, a bias signal for controlling the capacitance of the variable capacitance elements C1 to C5 to a desired value can be supplied individually to each of the variable capacitance elements C1 to C5 in a stable manner, and the dielectric constant in a thin film dielectric layer of the variable capacitance elements C1 to C5 that depends on a bias signal applied can be changed as desired. Thus, in the variable capacitance capacitor Ct', the capacitance component can be controlled easily. Thus, the characteristic impedance of the variable matching circuit M can be set to a desired characteristic impedance by the variable capacitance capacitor Ct', and according to the antenna of the invention using this, the operating frequency of the antenna can be adjusted as desired.

In other words, high frequency signals inputted to the variable capacitance elements C1 to C5 do not leak via the resistance components R11, R12, R13 of the first bias lines B11, B12, B13 and the resistance components R21, R22, R23 of the second bias lines B21, B22, B23, and the resistance component RI of the first common bias line BI and the resistance component RO of the second common bias line BO. This makes it possible that a bias signal is applied independently to the variable capacitance elements C1 to C5 in a stable manner. As a result, the capacitance change ratio of each of the variable capacitance elements C1 to C5 that depends on the bias signal can be utilized to the maximum.

In other words, in the variable capacitance capacitor Ct', N variable capacitance elements (N is an integer of at least 2), herein, five variable capacitance elements C1, C2, C3, C4, and C5 can be regarded as variable capacitance elements connected in series with each other with regard to high frequency component.

Therefore, a high frequency voltage applied to the variable capacitance elements C1, C2, C3, C4, and C5 that are connected in series with each other is divided into each of the variable capacitance elements C1, C2, C3, C4, and C5, so that the high frequency voltage applied to each of the variable capacitance elements C1, C2, C3, C4, and C5 is reduced. Therefore, in each variable capacitance elements C1 to C5, the capacitance variation with respect to high frequency signals can be suppressed to be small, the variable matching circuit M using the variable capacitance capacitor Ct' by these variable capacitance elements C1 to C5 and waveform distortion, intermodulation distortion or the like can be suppressed.

The serial connection of the variable capacitance elements C1, C2, C3, C4, and C5 has the same effect with respect to high frequency as the thickness of the dielectric layer of a capacitance element is increased. Thus, the amount of heat generated per unit volume due to loss resistance of the variable capacitance capacitor Ct' can be reduced, and the power handling capability of the variable matching circuit M can be improved.

Furthermore, the bias supply circuit is provided in the variable capacitance capacitor Ct', so that a conventionally used external bias supply circuit is not necessary, and therefore the variable matching circuit M can be compact and can be handled with ease.

When one end of the variable capacitance capacitor Ct' is connected to the ground, as shown in FIG. 10, the second common bias line RO is not particularly necessary.

Next, a method for producing the variable capacitance capacitor Ct' in this example will be described.

In FIGS. 11 to 12, the variable capacitance capacitor Ct' includes a support substrate 1, a lower electrode layer 2, conductor lines 31, 32, 33, and 34, a thin film dielectric layer 4, an upper electrode layer 5, thin film resistors 61, 62, 63, 64, 65 66, 67 and 68, an insulating layer 7, an extraction electrode layer 8, a protective layer 9, and a solder diffusion preventing layer 10 and the solder terminal portions 113 and 114. The solder diffusion preventing layer 10 and the solder terminal portion 113 constitutes a first signal terminal (input terminal), and The solder diffusion preventing layer 10 and the solder terminal portion 114 constitutes a second signal terminal (output terminal). Furthermore, the first bias terminal V1 and the second bias terminal V2 are produced at the same time when the lower electrode layer 2 is formed. The first bias terminal V1 is constituted by the solder diffusion preventing layer 10 and the solder terminal portion 113, and the second bias terminal V2 is constituted by the solder diffusion preventing layer 10 and the solder terminal portion 114.

The first common bias line BI is provided between the first bias terminal V1 and the first signal terminal. The second common bias line BO is provided between the second bias terminal V2 and the second signal terminal. The first common bias line BI and the second common bias line BO in this example are constituted by thin film resistors 67 and 68, respectively.

Then, as the material of the thin resistors 67 and 68 constituting the first and the second common bias lines BI and BO, a material containing tantalum (Ta) and having a specific resistance of 1 mΩ·cm or more is preferable. Specific examples thereof include tantalum nitride, TaSiN, Ta—Si—O. For example, in the case of tantalum nitride, the thin film resistors 67 and 68 having a desired composition ratio and resistivity can be formed by reactive sputtering in which sputtering is performed with nitrogen added, using Ta as a target.

By selecting the condition of the sputtering as appropriate, the thin film resistors 67 and 68 having a thickness of 40 nm or more and a specific resistance of 1 mΩ·cm or more can be formed. Furthermore, after the sputtering ends, patterning can be performed in a simple manner by performing etching process such as reactive ion etching (RIE) after a resist is applied arid processed to a predetermined shape.

When the variable capacitance capacitor Ct' is used at a frequency of 1 GHz, and the capacitance thereof is set to 1 pF, and the thin film resistors 67 and 68 are set to have a resistance 100 times or more as large as the impedance so that the impedance is not adversely affected at this frequency, then it is sufficient that the necessary resistance of the first and the second common bias lines BI and BO is about 16 kΩ or more. It is preferable that the specific resistivity of the thin film resistors 61 to 66 in the variable capacitance capacitor Ct' is 1 mΩ·cm or more, and therefore, for example, when 20 kΩ is to be obtained as the resistance of the first and the second common bias lines BI and BO, the aspect ratio (length/width) of the thin film resistors 67 and 68 can be 100 or less at a thickness of 50 nm. Therefore, the thin film resistors 67 and 68 can have a realizable aspect ratio without increasing the size of the element shape.

Then, an insulting layer 7 is necessary to ensure insulation with the extraction electrode layer 8 and the lower electrode layer 2 that are to be formed thereon. Furthermore, the insulating layer 7 covers the first and second common bias lines BI and BO and the first and the second bias lines B11, B12, B13, B21, B22, and B23, and can prevent the thin film resistors 61 to 68 from being oxidized. Therefore, the resistance of the first and second common bias lines BI and BO and the first and the second bias lines B11, B12, B13, B21, B22, and B23 can be made constant over time, and thus reliability can be improved. The material of the insulating layer 7 preferably contains at least one selected from silicon nitride and silicon oxide in order to improve moisture resistance. It is preferable to form the insulating layer by chemical vapor deposition (CVD) or the like in view of coatability.

The insulating layer 7 can be processed to a desired shape by dry etching using a regular resist. The insulating layer 7 is provided with through-holes reaching the conductor lines 33, 34 in order to expose portions of the conductor lines 33, 34 to establish a connection between the thin film resistors 61 to 66 and the extraction electrode layer 8. It is preferable that in view of improvement of moisture resistance that other than the through-holes, only the upper electrode layer 5 and the solder terminal portions 113 and 114 are exposed from the insulating layer 7.

Then, a protective layer 9 is formed so as to cover the whole with the solder terminal portions 111 and 112 exposed. The protective layer 9 serves to protect the components of the variable capacitance capacitor Ct' including the variable capacitance element C1 mechanically and from contamination due to chemicals or the like. However, when forming the protective layer 9, formation is performed such that the solder terminal portions 113, 114 are exposed. As the material of the protective layer 9, a material having high heat resistance and excellent coatability with respect to steps is preferable. Specific examples thereof include polyimide resin and BCB (benzocyclobutene) resin. The protective layer can be formed by applying raw materials of resin and curing the materials at a predetermined temperature.

The solder diffusion preventing layer 10 is formed to prevent the solder of the solder terminal portions 113, 114 from being diffused to the lower electrode layer 2 at the time of reflow when forming the solder terminal portions 113, 114 or mounting. As the material of the solder diffusion preventing layer 10, Ni is preferable. Au, Cu or other substances having high wettability with solder may be formed to a thickness of about 0.1 μm on the surface of the solder diffusion preventing layer 10 in order to improve the solder wettability.

Finally, the solder terminal portions 113 and 114 are formed. The solder terminal portions are formed to facilitate mounting to a wiring board outside the variable capacitance capacitor Ct'. In general, the solder terminal portions 113 and 114 are formed by printing a solder paste on a portion where the solder terminal portions 113 and 114 are to be formed, using a predetermined mask and then performing reflow.

According to the variable capacitance capacitor Ct' described above, the thin film resistors 61 to 68 containing tantalum nitride and having a specific resistance of 1 mΩ·cm or more is used in the first and second common bias lines BI, BO, the first and the second bias lines B11, B12, B13, B21, B22, and B23 or a portion thereof, so that the aspect ratio of the thin film resistors 61 to 68 is reduced and thus a compact variable capacitance capacitor is realized. Furthermore, the first and the second common bias lines B11, B12, B13, B21, B22, and B23 are formed directly on the support substrate 1, so that the number of the layers constituting each element such as the variable capacitance elements C1 is reduced. Moreover, since the process of forming the conductor layer, the dielectric layer and other layers constituting each element is performed in common with other elements, the variable capacitance capacitor can be formed in a simply manner, although the configuration is relatively complex.

According to the antenna of the invention, the variable matching circuit M having the thus produced variable capacitance capacitor Ct' is connected between the feeding terminal 212 of the antenna element 211 and the feeding power source 213. In the variable capacitance capacitor Ct' of the variable matching circuit M. Since the plurality of variable capacitance elements C1 to C5 such as the variable capacitance element C1 are connected in series with each other with regard to high frequency component, a high frequency voltage applied to the plurality of variable capacitance elements C1 to C5 is divided into each of the variable capacitance elements C1 to C5. Therefore, the high frequency voltage applied individually to the variable capacitance elements C1 to C5 is divided and thus reduced, so that, the capacitance variation of the variable capacitance capacitor Ct' with respect to high frequency signals can be suppressed to be small. Consequently, in the antenna, waveform distortion, intermodulation distortion or the like can be suppressed. In addition, since the plurality of variable capacitance elements C1 to C5 are connected in series with each other with regard to high frequency component, the same effect as the thickness of the dielectric layer of the variable capacitance element is increased can be obtained, and the amount of heat generated per unit volume due to loss resistance of the variable capacitance capacitor Ct' can be reduced. Therefore, the power handling capability of the antenna can be improved.

According to the antenna of the invention, the plurality of variable capacitance elements C1 to C5 using a thin film dielectric layer whose dielectric constant is changed by a voltage applied to the variable capacitance capacitor Ct' that is connected between the feeding terminal 212 of the antenna element 211 and the feeding power source 213 are used. Thus, the loss in the variable capacitance capacitor Ct' can be reduced at high frequencies, and therefore the loss of the antenna can be reduced.

Furthermore, according to the antenna of the invention, when the variable capacitance capacitor Ct' has a bias supply circuit that is connected to electrodes of the plurality of variable capacitance elements C1 to C5 and includes at least one of a resistance component and an inductor component, then an independent bias supply circuit that is mounted on an external wiring board as in a conventional variable matching circuit is not necessary, and therefore the antenna can be compact and can be handled with ease.

As described above, according to the invention, the operating frequency can be changed easily and stably to a desired frequency, and therefore an antenna having small waveform distortion and intermodulation distortion, high power handling capability and low loss can be provided. Furthermore, an independent bias supply circuit is not necessary, and therefore a compact antenna that can be handled with ease and in which the operating frequency of the antenna can be varied can be provided.

Then, a wireless communication apparatus (not shown) of the invention includes the antenna of the invention as described above, and at least one of a transmitting circuit and a receiving circuit, the one being connected to the antenna. Furthermore, a wireless signal processing circuit may be connected to the antenna, the transmitting circuit or the receiving circuit in order to allow wireless communication, as desired, or other various configuration can be used.

According to such a wireless communication apparatus of the invention, the antenna of the invention as above, and at least one of the transmitting circuit and the receiving circuit corresponding to a wireless signal of various different frequency bands, the one being connected to the antenna, are included. Therefore, a compact, high performance and frequency variable wireless communication apparatus that is operable at various different frequencies with one antenna that can be of low height and small size, has good antenna characteristics with respect to a desired frequency in a variable range of the frequency while achieving a low height and a small size of the device, and can perform good wireless communication at variable frequencies can be provided.

Figure 13:
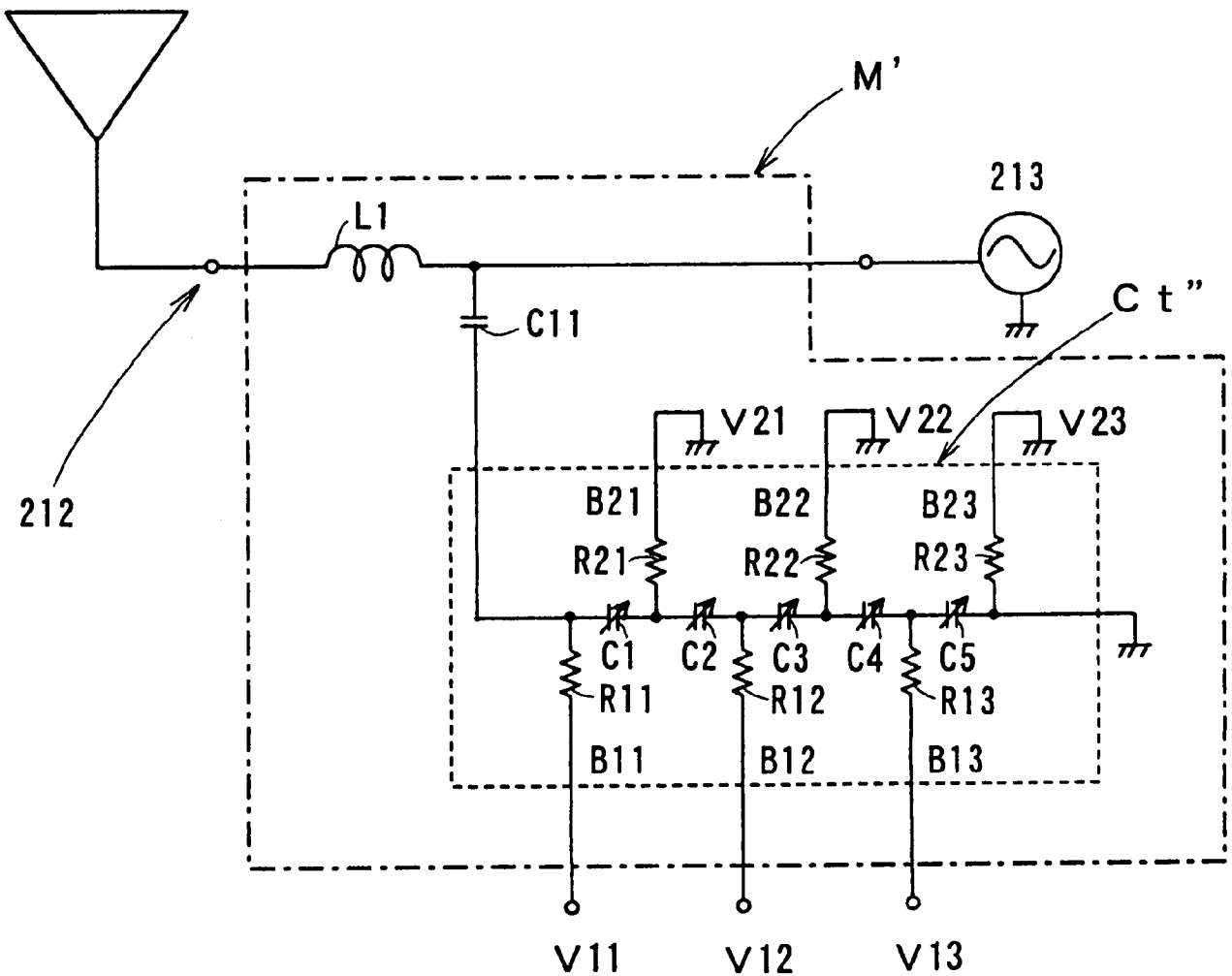
FIG. 13 is an equivalent circuit diagram showing an antenna according to a sixth embodiment of the invention in which bias supply circuits are individually provided.
Figure 14:
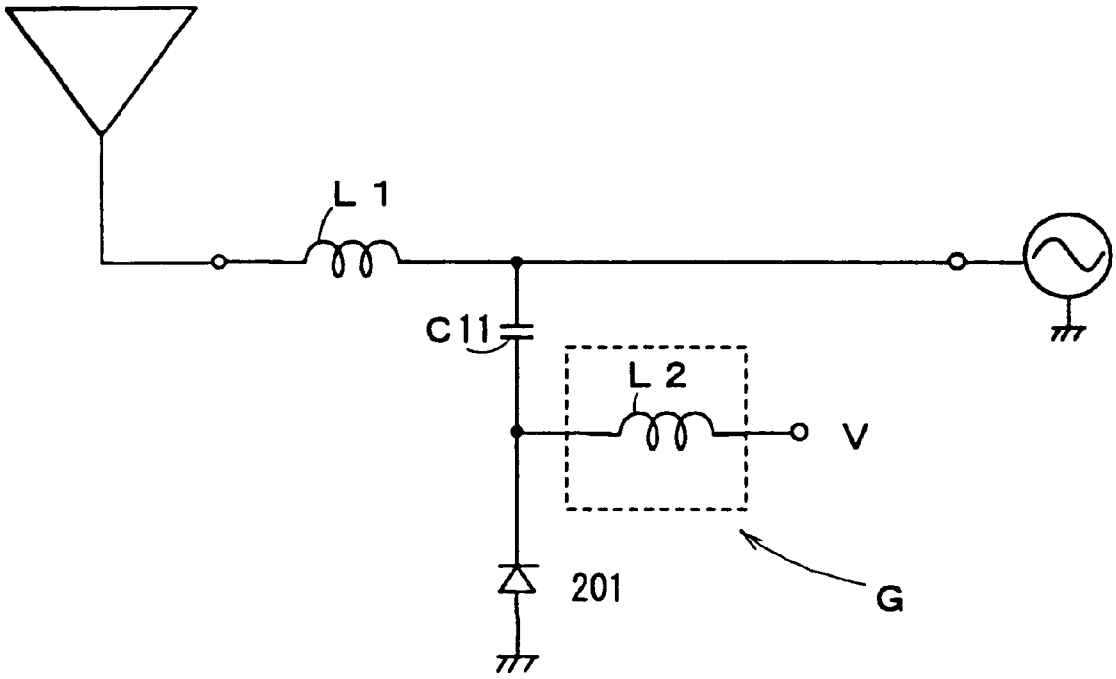
FIG. 14 PRIOR ART
FIG. 14 is an equivalent circuit diagram showing an example of a conventional antenna.

The invention is not limited to the embodiment examples as described above, and various modification can be added to the invention within the range that does not depart from the gist of the invention. For example, in an example of the embodiment, the first and second common bias lines BI and BO, which constitutes a bias supply circuit in the variable capacitance capacitor Ct', are common. However, as shown in the equivalent circuit diagram showing the antenna according to a sixth embodiment of the invention in FIG. 13, the variable matching circuit M' can have a variable capacitance capacitor Ct" in which the bias lines B11, B12, B13, B21, B22, and B23, which constitute a bias supply circuit, are provided individually with respect to the variable capacitance elements C1, C2, C3, C4, and C5.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An antenna comprising:

an antenna element; and a variable capacitance capacitor connected between the antenna element and a ground, including an antenna-element-side terminal and a ground-side terminal, wherein in the variable capacitance capacitor, a plurality of variable capacitance elements using a thin film dielectric layer whose dielectric constant is changed by a voltage applied are connected between the antenna-element-side terminal and the ground-side terminal, in parallel to each other with regard to direct current component and in series with each other with respect to high frequency component.

2. The antenna of claim 1, wherein the variable capacitance capacitor has a bias supply circuit that is connected to electrodes of the plurality of variable capacitance elements and includes at least one of a resistance component and an inductor component.

3. The antenna of claim 1, wherein the thin film dielectric layer is a dielectric layer having high dielectric constant made of a perovskite oxide crystal containing at least Ba, Sr, and Ti.

4. A wireless communication apparatus comprising:

the antenna of claim 1; and at least one of a transmitting circuit and a receiving circuit, the one being connected to the antenna.

5. An antenna comprising:

an antenna element having a feeding terminal; and a variable matching circuit which is connected between the feeding terminal of the antenna element and a feeding power source and has a variable capacitance capacitor including an input terminal and an output terminal, wherein in the variable capacitance capacitor, a plurality of variable capacitance elements using a thin film dielectric layer whose dielectric constant is changed by a voltage applied are connected between the input terminal and the output terminal, in parallel to each other with regard to direct current component and in series with each other with regard to high frequency component.

6. The antenna of claim 5, wherein the variable capacitance capacitor has a bias supply circuit that is connected to electrodes of the plurality of variable capacitance elements and includes at least one of a resistance component and an inductor component.

7. The antenna of claim 5, wherein the thin film dielectric layer is a dielectric layer having high dielectric constant made of a perovskite oxide crystal containing at least Ba, Sr, and Ti.

8. A wireless communication apparatus comprising:

the antenna of claim 5; and at least one af a transmitting circuit and a receiving circuit, the one being connected to the antenna.

* * * * *